US006289558B1

(12) United States Patent
Hammerslag

(10) Patent No.: US 6,289,558 B1
(45) Date of Patent: Sep. 18, 2001

(54) FOOTWEAR LACING SYSTEM

(75) Inventor: Gary R. Hammerslag, Steamboat Springs, CO (US)

(73) Assignee: BOA Technology, Inc., Steamboat Springs, CO (US)

( * ) Notice: Subject to any disclaimer, the term of this patent is extended or adjusted under 35 U.S.C. 154(b) by 0 days.

(21) Appl. No.: 09/388,756

(22) Filed: Sep. 2, 1999

Related U.S. Application Data

(63) Continuation-in-part of application No. 09/337,763, filed on Jun. 22, 1999, which is a continuation of application No. 08/917,056, filed on Aug. 22, 1997, now Pat. No. 5,934,599.

(51) Int. Cl.[7] ..... A43C 11/00; A43B 5/16

(52) U.S. Cl. ..... 24/68 SK; 24/714.6; 36/50.5

(58) Field of Search ..... 36/50.1, 50.5; 24/714.6–715.2, 68 SK, 71.1, 909

(56) References Cited

U.S. PATENT DOCUMENTS

| | | | |
|---|---|---|---|
| 746,563 | | 12/1903 | McMahon . |
| 908,704 | | 1/1909 | Sprinkle . |
| 1,060,422 | | 4/1913 | Bowdish . |
| 1,062,511 | | 5/1913 | Short . |
| 1,090,438 | | 3/1914 | Worth et al. . |
| 1,170,472 | | 2/1916 | Barber . |
| 1,288,859 | | 12/1918 | Feller et al. . |
| 1,393,188 | | 10/1921 | Whiteman . |
| 1,412,486 | | 4/1922 | Paine . |
| 1,416,203 | | 5/1922 | Hobson . |
| 1,469,661 | | 10/1923 | Migita . |
| 1,481,903 | | 1/1924 | Hart . |
| 1,530,713 | | 3/1925 | Clarkk . |
| 2,109,751 | | 3/1938 | Matthias et al. . |
| 2,539,026 | * | 1/1951 | Mangold . |
| 3,112,545 | | 12/1963 | Williams . |
| 3,163,900 | | 1/1965 | Martin . |
| 3,430,303 | | 3/1969 | Perrin et al. . |
| 4,130,949 | | 12/1978 | Siedel . |
| 4,142,307 | * | 3/1979 | Martin . |
| 4,261,081 | | 4/1981 | Lott . |
| 4,433,456 | | 2/1984 | Baggio . |
| 4,620,378 | | 11/1986 | Sartor . |
| 4,633,599 | | 1/1987 | Morell et al. . |
| 4,654,985 | | 4/1987 | Chalmers . |
| 4,660,300 | | 4/1987 | Morell et al. . |
| 4,680,878 | | 7/1987 | Pozzobon et al. . |
| 4,719,670 | | 1/1988 | Kurt . |
| 4,719,710 | | 1/1988 | Pozzobon . |

(List continued on next page.)

FOREIGN PATENT DOCUMENTS

| | | | |
|---|---|---|---|
| 3822113 | * | 1/1990 | (DE) . |
| 2399811 | * | 3/1979 | (FR) . |
| 11673 | | 6/1899 | (GB) . |
| WO 00/76337 A1 | | 12/2000 | (WO) . |
| WO 00/76603 A1 | | 12/2000 | (WO) . |

OTHER PUBLICATIONS

ASOLO® Boot Brochure/Catalog, undated.

*Primary Examiner*—James R. Brittain
(74) *Attorney, Agent, or Firm*—Knobbe, Martens, Olson & Bear, LLP

(57) ABSTRACT

Disclosed is a footwear lacing system comprising a lace attached to a tightening mechanism. The lace is threaded through a series of opposing guide members positioned along the top of the foot and ankle portions of the footwear. The lace and guide preferably have low friction surfaces to facilitate sliding of the lace along the guide members so that the lace evenly distributes tension across the footwear member. The tightening mechanism allows incremental adjustment of the tension of the lace. A release mechanism allows a user to quickly loosen the lace.

18 Claims, 25 Drawing Sheets

U.S. PATENT DOCUMENTS

| | | | |
|---|---|---|---|
| 4,741,115 | | 5/1988 | Pozzobon . |
| 4,748,726 | | 6/1988 | Schoch . |
| 4,760,653 | | 8/1988 | Baggio . |
| 4,780,969 | | 11/1988 | White, Jr. . |
| 4,787,124 | * | 11/1988 | Pozzobon et al. . |
| 4,796,829 | | 1/1989 | Pozzobon et al. . |
| 4,799,297 | | 1/1989 | Baggio et al. . |
| 4,826,098 | | 5/1989 | Tracy . |
| 4,841,649 | | 6/1989 | Baggio et al. . |
| 4,870,861 | | 10/1989 | Tracy . |
| 4,884,760 | | 12/1989 | Baggio et al. . |
| 4,961,544 | * | 10/1990 | Bidoia . |
| 5,001,817 | | 3/1991 | De Bortoli et al. . |
| 5,016,327 | | 5/1991 | Klauser . |
| 5,042,177 | * | 8/1991 | Schoch . |
| 5,062,225 | | 11/1991 | Gorza . |
| 5,065,480 | | 11/1991 | De Bortoli et al. . |
| 5,065,481 | | 11/1991 | Walkhoff . |
| 5,117,567 | | 6/1992 | Berger . |
| 5,152,038 | | 10/1992 | Schoch . |
| 5,157,813 | * | 10/1992 | Carroll . |
| 5,177,882 | | 1/1993 | Berger . |
| 5,181,331 | | 1/1993 | Berger . |
| 5,184,378 | | 2/1993 | Batra . |
| 5,249,377 | | 10/1993 | Walkhoff . |
| 5,259,094 | | 11/1993 | Zepeda . |
| 5,315,741 | | 5/1994 | Dubberke . |
| 5,325,613 | | 7/1994 | Sussmann . |
| 5,335,401 | | 8/1994 | Hanson . |
| 5,345,697 | | 9/1994 | Quellais . |
| 5,430,960 | * | 7/1995 | Richardson . |
| 5,463,822 | | 11/1995 | Miller . |
| 5,477,593 | | 12/1995 | Leick . |
| 5,502,902 | | 4/1996 | Sussmann . |
| 5,511,325 | | 4/1996 | Hieblinger . |
| 5,535,531 | * | 7/1996 | Karabed et al. . |
| 5,557,864 | | 9/1996 | Marks . |
| 5,566,474 | | 10/1996 | Leick et al. . |
| 5,600,874 | | 2/1997 | Jungkind . |
| 5,606,778 | | 3/1997 | Jungkind . |
| 5,638,588 | | 6/1997 | Jungkind . |
| 5,640,785 | | 6/1997 | Egelja . |
| 5,647,104 | | 7/1997 | James . |
| 5,651,198 | | 7/1997 | Sussmann . |
| 5,718,021 | | 2/1998 | Tatus . |
| 5,732,483 | | 3/1998 | Cagliari . |
| 5,737,854 | | 4/1998 | Sussmann . |
| 5,934,599 | | 8/1999 | Hammerslag . |

* cited by examiner

FOOTWEAR LACING SYSTEM

This application is a continuation-in-part of U.S. patent application Ser. No. 09/337,763, entitled Footwear Lacing System, filed Jun. 22, 1999, which is a continuation of U.S. patent application Ser. No. 08/917,056 filed on Aug. 22, 1997, now U.S. Pat. No. 5,934,599 issued on Aug. 10, 1999.

The present invention relates to footwear. More particularly, the present invention relates to a low-friction lacing system that provides equilibrated tightening pressure across a wearer's foot for sports boots and shoes.

BACKGROUND OF THE INVENTION

There currently exists a number of mechanisms and methods for tightening a shoe or boot around a wearer's foot. A traditional method comprises threading a lace in a zig-zag pattern through eyelets that run in two parallel rows attached to opposite sides of the shoe. The shoe is tightened by first tensioning opposite ends of the threaded lace to pull the two rows of eyelets towards the midline of the foot and then tying the ends in a knot to maintain the tension. A number of drawbacks are associated with this type of lacing system. First, laces do not adequately distribute the tightening force along the length of the threaded zone, due to friction between the lace and the eyelets, so that portions of the lace are slack and other portions are in tension. Consequently, the higher tensioned portions of the shoe are tighter around certain sections of the foot, particularly the ankle portions which are closer to the lace ends. This is uncomfortable and can adversely affect performance in some sports.

Another drawback associated with conventional laces is that it is often difficult to untighten or redistribute tension on the lace, as the wearer must loosen the lace from each of the many eyelets through which the laces are threaded. The lace is not easily released by simply untightening the knot. The friction between the lace and the eyelets often maintains the toe portions and sometimes much of the foot in tension even when the knot is released. Consequently, the user must often loosen the lace individually from each of the eyelets. This is especially tedious if the number of eyelets is high, such as in ice-skating boots or other specialized high performance footwear.

Another tightening mechanism comprises buckles which clamp together to tighten the shoe around the wearer's foot. Typically, three to four or more buckles are positioned over the upper portion of the shoe. The buckles may be quickly clamped together and drawn apart to tighten and loosen the shoe around the wearer's foot. Although buckles may be easily and quickly tightened and untightened, they also have certain drawbacks. Specifically, buckles isolate the closure pressure across three or four points along the wearer's foot corresponding to the locations of the buckles. This is undesirable in many circumstances, such as for the use of sport boots where the wearer desires a force line that is evenly distributed along the length of the foot. Another drawback of buckles is that they are typically only useful for hard plastic or other rigid material boots. Buckles are not as practical for use with softer boots, such as ice skates or snowboard boots.

There is therefore a need for a tightening system for footwear that does not suffer from the aforementioned drawbacks. Such a system should automatically distribute lateral tightening forces along the length of the wearer's ankle and foot. The tightness of the shoe should desirably be easy to loosen and incrementally adjust. The tightening system should close tightly and should not loosen up with continued use.

SUMMARY OF THE INVENTION

There is provided in accordance with one aspect of the present invention, a closure system for drawing first and second sides of an article of footwear towards each other to tighten the footwear around a foot. The closure system comprises a rotatable spool for receiving a lace, the spool rotatable in a first direction to take up lace and a second direction to release lace. A knob is connected to the spool such that the spool can be rotated in the first direction in response to rotation of the knob. A releasable lock is provided for preventing rotation of the spool in the second direction. Releasing the lock permits the spool to rotate in the second direction in response to tension the lace, but the spool is not rotatable in the second direction in response to rotation of the knob. In one embodiment, the knob is only rotatable in the first direction.

In accordance with another aspect of the present invention, there is provided a footwear lacing system. The system comprises a footwear member, including a first and second opposing sides configured to fit around a foot. A plurality of opposing cable guide members are positioned on the opposing sides. A cable is guided by the guide members, and has a first end and a second end. The first and second ends are removably secured with respect to the spool. A tightening mechanism is attached to the footwear and coupled to the spool. The tightening mechanism includes a control for winding the cable around the spool to place tension on the cable, thereby pulling opposing sides of the footwear towards each other.

Preferably, the first and second ends of the cable are removably connected to the spool such that the cable may be removed from the footwear lacing system without removing the spool. In one embodiment, the cable comprises a plurality of strands which, preferably, are secured together at each of the first and second ends. The strands in one embodiment are secured by welds.

Preferably, the footwear further comprises at least one expansion limiting band, which resides in an expansion limiting plane. The expansion limiting band in one embodiment surrounds the wearer's ankle, such that the expansion limiting plane extends generally horizontally through the footwear.

In accordance with a further aspect of the present invention, there is provided a dynamic footwear lacing system. The lacing system comprises a footwear member including at least a foot portion and an ankle portion, and first and second opposing sides configured to fit around a foot. A plurality of opposing guide members are positioned along the opposing sides. A cable slideably extends along the guide members, such that anterior flexing of the leg at the ankle causes a loosening of the lace in the ankle portion and a corresponding tightening of the lace in the foot portion and subsequent posterior flexing of the leg at the ankle permits a tightening of the lace in the ankle portion and a corresponding loosening of the lace in the foot portion. An expansion limiting strap surrounds at least a portion of the footwear.

In accordance with another aspect of the present invention, there is provided a method of balancing tension along the length of a lacing zone in a boot. The method comprises the steps of providing a boot having first and second opposed sets of guide members, and a lace extending back and forth between the first and second opposed guide members. The guide members define a pathway through which the lace slides, and a rotatable tightening mechanism is provided on the boot for retracting lace thereby advancing the first and second set of opposed guide members towards each other to tighten the boot. The tightening mechanism is rotated to retract lace thereby advancing the first and second opposing sets of guide members towards each other to tighten the boot. The lace is permitted to slide through the guide members, to distribute the tightening force along the length of the guide members and to equilibrate tightening force along the length of the lacing zone on the boot. Expansion in at least one plane through the lacing zone is limited by fastening an expansion limiting strap in that plane.

Further features and advantages of the present invention will become apparent from the detailed description of preferred embodiments which follows, when considered together with the attached drawings and claims.

DETAILED DESCRIPTION OF PREFERRED EMBODIMENTS

Figure 1:
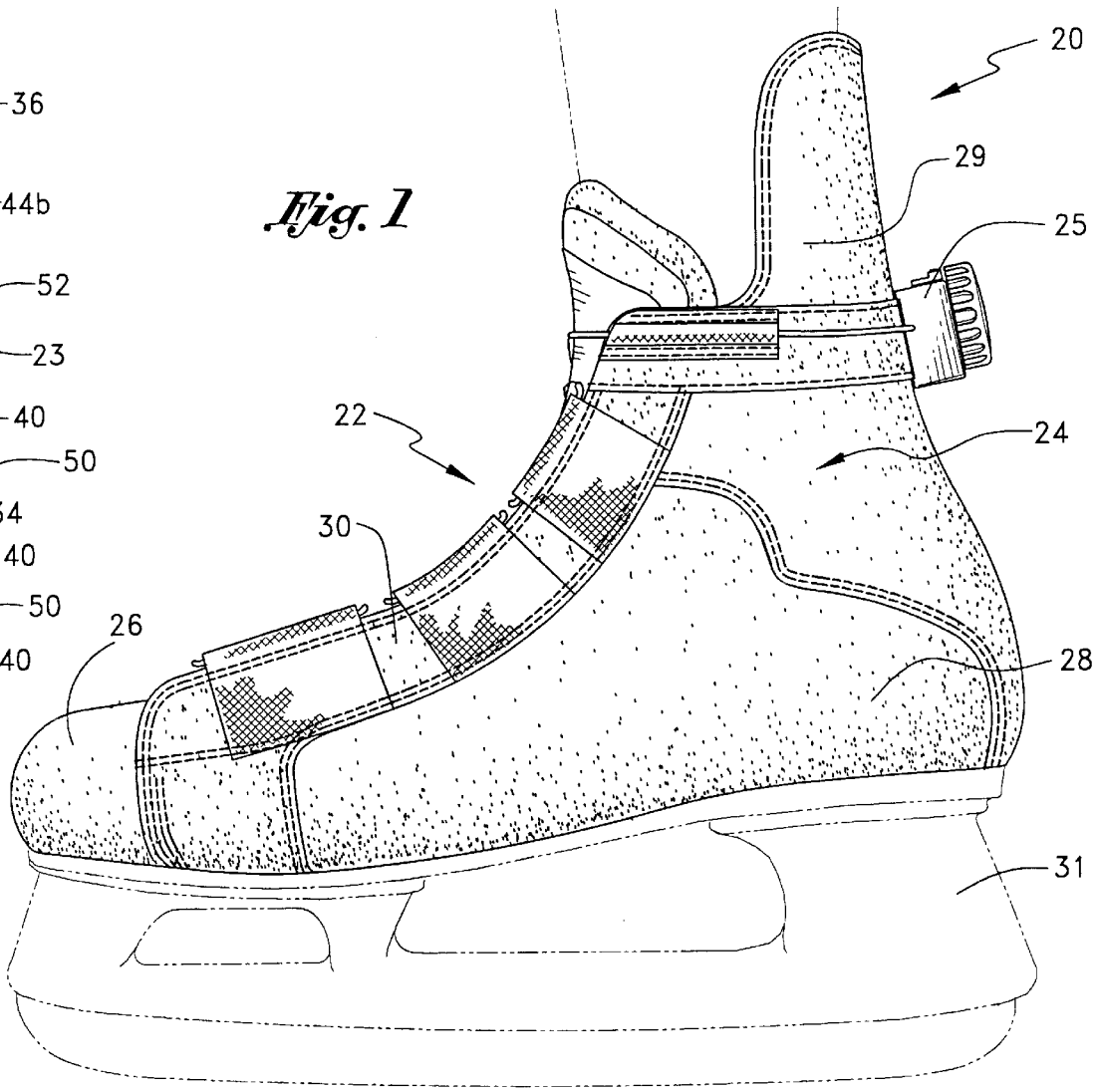
FIG. 1 is a side view of a sport boot including a lacing system configured in accordance with the present invention.

Referring to FIG. 1, there is disclosed one embodiment of a sport boot 20 prepared in accordance with the present invention. The sport boot 20 generally comprises an ice skating or other action sport boot which is tightened around a wearer's foot using a lacing system 22. The lacing system 22 includes a lace 23 (FIG. 2) that is threaded through the boot 20 and attached at opposite ends to a tightening mechanism 25, as described in detail below. As used herein, the terms lace and cable have the same meaning unless specified otherwise. The lace 23 is a low friction lace that slides easily through the boot 20 and automatically equilibrates tightening of the boot 20 over the length of the lacing zone, which generally extends along the ankle and foot. Although the present invention will be described with reference to an ice skating boot, it is to be understood that the principles discussed herein are readily applicable to any of a wide variety of footwear, and are particularly applicable to sports shoes or boots suitable for snow boarding, roller skating, skiing and the like.

The boot 20 includes an upper 24 comprising a toe portion 26, a heel portion 28, and an ankle portion 29 that surrounds the wearer's ankle. An instep portion 30 of the upper 24 is interposed between the toe portion 26 and the ankle portion 29. The instep portion 30 is configured to fit around the upper part of the arch of the medial side of the wearer's foot between the ankle and the toes. A blade 31 (shown in phantom lines) extends downward from the bottom of the boot 20 in an ice-skating embodiment.

Figure 2:
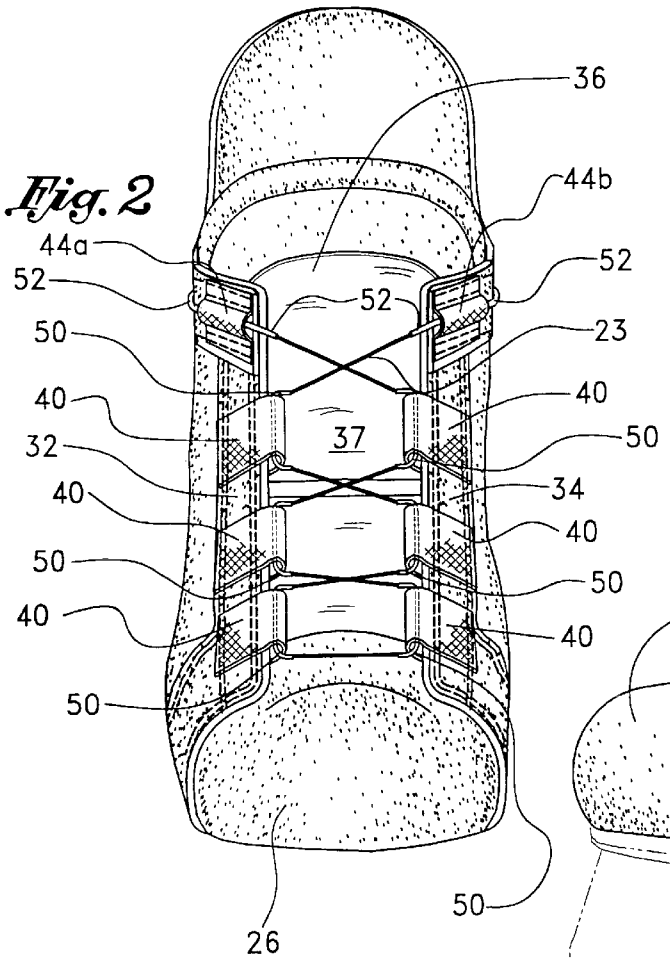
FIG. 2 is a front view of the sport boot of FIG. 1.

FIG. 2 is a front elevational view of the boot 20. As shown, the top of the boot 20 generally comprises two opposed closure edges or flaps 32 and 34 that partially cover a tongue 36. Generally, the lace 23 may be tensioned to draw the flaps 32 and 34 toward each other and tighten the boot 20 around the foot, as described in detail below. Although the inner edges of the flaps 32 and 34 are shown separated by a distance, it is understood that the flaps 32 and 34 could also be sized to overlap each other when the boot 20 is tightened, such as is known with ski footwear. Thus, references herein to drawing opposing sides of footwear towards each other refers to the portion of the footwear on the sides of the foot. This reference is thus generic to footwear in which opposing edges remain spaced apart even when tight (e.g. tennis shoes) and footwear in which opposing edges may overlap when tight (e.g. certain snow skiing boots). In both, tightening is accomplished by drawing opposing sides of the footwear towards each other.

Referring to FIG. 2, the tongue 36 extends rearwardly from the toe portion 26 toward the ankle portion 29 of the boot 20. Preferably, the tongue 36 is provided with a low friction top surface 37 to facilitate sliding of the flaps 32 and 34 and lace 23 over the surface of the tongue 32 when the lace 23 is tightened. The low friction surface 37 may be formed integrally with the tongue 32 or applied thereto such as by adhesives, heat bonding, stitching or the like. In one embodiment, the surface 37 is formed by adhering a flexible layer of nylon or polytetrafluoroethylene to the top surface of the tongue 36. The tongue 36 is preferably manufactured of a soft material, such as leather.

The upper 24 may be manufactured from any from a wide variety of materials known to those skilled in the art. In the case of a snow board boot, the upper 24 is preferably manufactured from a soft leather material that conforms to the shape of the wearer's foot. For other types of boots or shoes, the upper 24 may be manufactured of a hard or soft plastic. It is also contemplated that the upper 24 could be manufactured from any of a variety of other known materials.

As shown in FIG. 2, the lace 23 is threaded in a crossing pattern along the midline of the foot between two generally parallel rows of side retaining members 40 located on the flaps 32 and 34. In the illustrated embodiment, the side retaining members 40 each consist of a strip of material looped around the top and bottom edges of the flaps 32 and 34 so as to define a space in which guides 50 are positioned. The lace 23 slides through the guides 50 during tightening and untightening of the lace 23, as described more fully below. In the illustrated embodiment, there are three side retaining members 40 on each flap 32, 34 although the number of retaining members 40 may vary. In some embodiments, four, five or six or more retaining members 40 may be desirable on each side of the boot.

The guides 50 may be attached to the flaps 32 and 34 or to other spaced apart portions of the shoe through any of a variety of manners, as will be appreciated by those of skill in the art in view of the disclosure herein. For example, the retaining members 40 can be deleted and the guide 50 sewn directly onto the surface of the flap 32 or 34 or opposing sides of the upper. Stitching the guide 50 directly to the flap 32 or 34 may advantageously permit optimal control over the force distribution along the length of the guide 50. For example, when the lace 23 is under relatively high levels of tension, the guide 50 may tend to want to bend and to possibly even kink near the curved transition in between longitudinal portion 51 and transverse portion 53 as will be discussed. Bending of the guide member under tension may increase friction between the guide member and the lace 23, and, severe bending or kinking of the guide member 50 may undesirably interfere with the intended operation of the lacing system. Thus, the attachment mechanism for attaching the guide member 50 to the shoe preferably provides sufficient support of the guide member to resist bending and/or kinking. Sufficient support is particularly desirable on the inside radius of any curved portions particularly near the ends of the guide member 50.

As shown in FIGS. 1 and 2, the lace 23 also extends around the ankle portion 29 through a pair of upper retaining members 44*a* and 44*b* located on the ankle portion 29. The upper retaining members 44*a* and 44*b* each comprise a strip of material having a partially raised central portion that defines a space between the retaining members 44 and the upper 24. An upper guide member 52 extends through each of the spaces for guiding the lace 23 around either side of the ankle portion 29 to the tightening mechanism 25.

Figure 3:
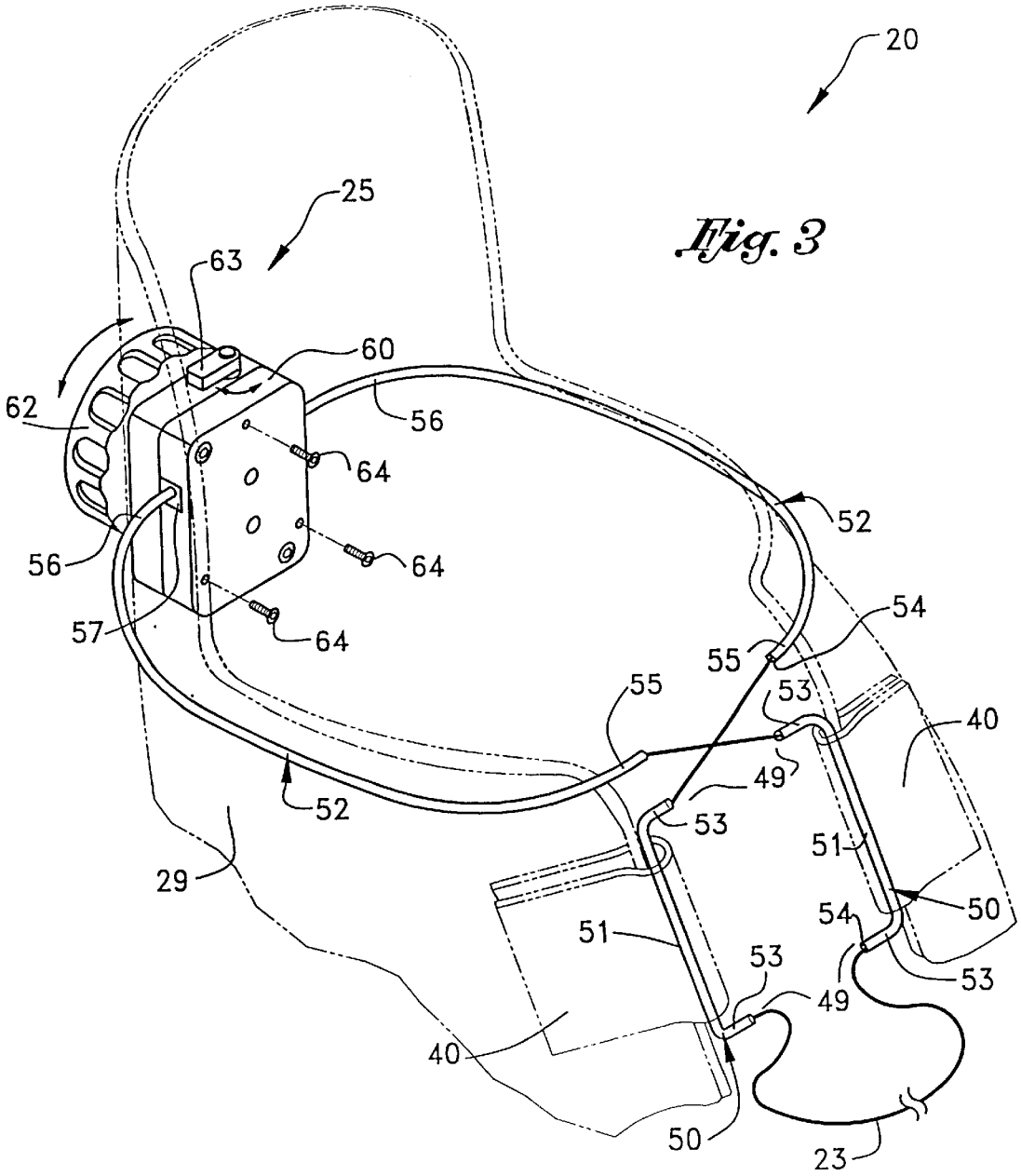
FIG. 3 is a perspective schematic view of the lacing system of the sport boot of FIG. 1.

FIG. 3 is a schematic perspective view of the lacing system 22 of the boot 20. As shown, each of the side and top guide members 50 and 52, has a tube-like configuration having a central lumen 54. Each lumen 54 has an inside diameter that is larger than the outside diameter of the lace 23 to facilitate sliding of the lace 23 through the side and top guide members 50, 52 and prevent binding of the lace 23 during tightening and untightening. In one embodiment, the inside diameter of the lumen is approximately 0.040 inches, to cooperate with a lace having an outside diameter of about 0.027". However, it will be appreciated that the diameter of the lumen 54 can be varied to fit specific desired lace dimensions and other design considerations. Each of the guide members 50 and 52 defines a pair of openings 49 that communicate with opposite ends of the lumen 54. The openings 49 function as inlets/outlets for the lace 23. The openings desirably are at least as wide as the cross-section of the lumen 54.

In the illustrated embodiment, the side guide members 50 each have a generally U-shape that opens towards the midline of the shoe. Preferably, each of the side guide members 50 comprise a longitudinal portion 51 and two inclined or transverse portions 53 extending therefrom. The length of the longitudinal portion 51 may be varied to adjust the distribution of the closing pressure that the lace 23 applies to the upper 24 when the lace 23 is under tension. In addition, the length of the longitudinal portion 51 need not be the same for all guide members 50 on a particular shoe. For example, the longitudinal portion 51 may be shortened near the ankle portion 29 to increase the closing pressure that the lace 23 applies to the ankles of the wearer. In general, the length of the longitudinal portion 51 will fall within the range of from about ½" to about 3", and, in some embodiments, within the range of from about ¼" to about 4". In one snowboard application, the longitudinal portion 51 had a length of about 2". The length of the transverse portion 53 is generally within the range of from about ⅛" to about 1". In one snowboard embodiment, the length of transverse portion 53 was about ½". Different specific length combinations can be readily optimized for a particular boot design through routine experimentation by one of ordinary skill in the art in view of the disclosure herein.

In between the longitudinal portion 51 and transverse portion 53 is a curved transition. Preferably, the transition has a substantially uniform radius throughout, or smooth progressive curve without any abrupt edges or sharp changes in radius. This construction provides a smooth surface over which the lace 23 can slide, as it rounds the corner. The transverse section 53 can in some embodiments be deleted, as long as a rounded cornering surface is provided to facilitate sliding of the lace 23. In an embodiment which has a transverse section 53 and a radiused transition, with a guide member 50 having an outside diameter of 0.090" and a lace 23 having an outside diameter of 0.027", the radius of the transition is preferably greater than about 0.1", and generally within the range of from about 0.125" to about 0.4".

Referring to FIG. 3, the upper guide members 52 extend substantially around opposite sides of the ankle portion 29. Each upper guide member 52 has a proximal end 56 and a distal end 55. The distal ends 55 are positioned near the top of the tongue 36 for receipt of the lace 23 from the uppermost side guide members 50. The proximal ends 56 are coupled to the tightening mechanism 25. In the illustrated embodiment, the proximal ends 56 include rectangular coupling mounts 57 that engage with the tightening mechanism 25 for feeding the ends of the lace 23 therein, as described more fully below. The guide members 50 and/or 52 are preferably manufactured of a low friction material, such as a lubricous polymer or metal, that facilitates the slideability of the lace 23 therethrough. Alternatively, the guides 50, 52 can be made from any convenient substantially rigid material, and then be provided with a lubricous coating on at least the inside surface of lumen 54 to enhance slideability. The guide members 50 and 52 are preferably substantially rigid to prevent bending and kinking of the guide members 50, 52 and/or the lace 23 within any of the guide members 50 and 52 as the lace 23 is tightened. The guide members 50, 52 may be manufactured from straight tube of material that is cold bent or heated and bent to a desired shape.

Alternatively, the guide members 50, 52 may be constructed in a manner that permits bending, retains a low friction surface, yet resist kinking. For example, guide members 50, 52 may comprise a spring coil, either with the spring coil exposed or the spring coil provided with a polymeric coating on the inside surface or outside surface or both. The provision of a spring coil guide satisfies the need for lateral flexibility in some embodiments, yet retains a hard interior surface which help to minimize friction between the guide and the lace.

As an alternate guide member 50, 52 design which increases lateral flexibility yet retains a hard interior lace contacting surface, the guide 50 may comprise a plurality of coaxially-aligned segments of a hard polymeric or metal tube material. Thus, a plurality of tubing segments, each segment having an axial length within the range of from about 0.1" to about 1.0", and preferably about 0.25" or less can be coaxially aligned, either in end-to-end contact or axially spaced apart along the length of the guide 50, 52. Adjacent tubular segments can be maintained in a coaxial relationship such as by the provision of an outer flexible polymeric jacket. The shape of the tubular guide may be retained such as by stitching the guide onto the side of the shoe in the desired orientation, or through other techniques which will be apparent to those of skill in the art in view of the disclosure herein.

As an alternative to the previously described tubular guide members, the guide members 50 and/or 52 comprise an open channel having, for example, a semicircular or "U" shaped cross section. The guide channel is preferably mounted on the boot such that the channel opening faces away from the midline of the boot, so that a lace under tension will be retained therein. One or more retention strips, stitches or flaps may be provided for "closing" the open side of the channel, to prevent the lace from escaping when tension on the lace is released. The axial length of the channel can be preformed in a generally U configuration like the illustrated tubular embodiment, and may be continuous or segmented as described in connection with the tubular embodiment.

Several guide channels may be molded as a single piece, such as several guide channels molded to a common backing support strip which can be adhered or stitched to the shoe. Thus, a right lace retainer strip and a left lace retainer strip can be secured to opposing portions of the top or sides of the shoe to provide a right set of guide channels and a left set of guide channels.

Figure 4B:
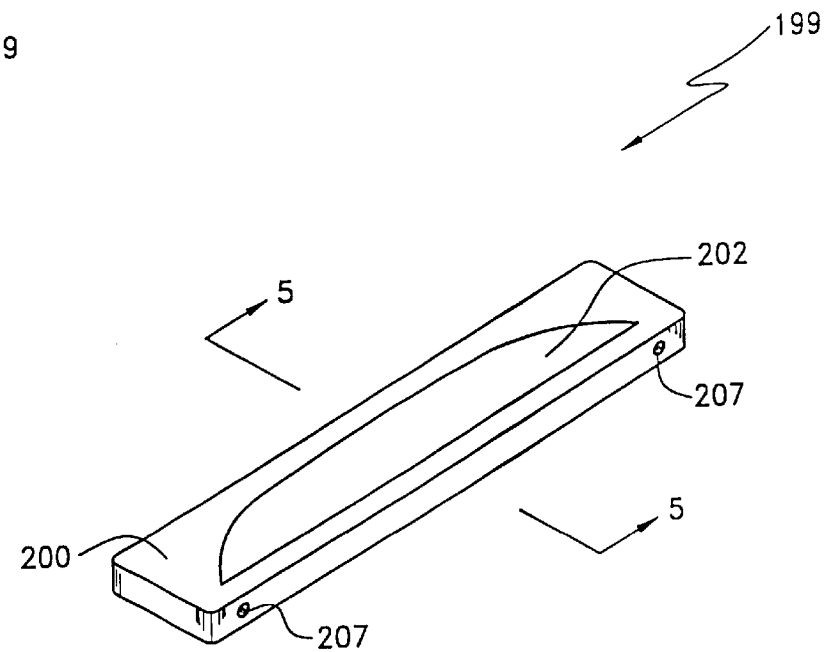
FIG. 4B is a perspective view of an assembled multi-piece guide member.
Figure 4A:
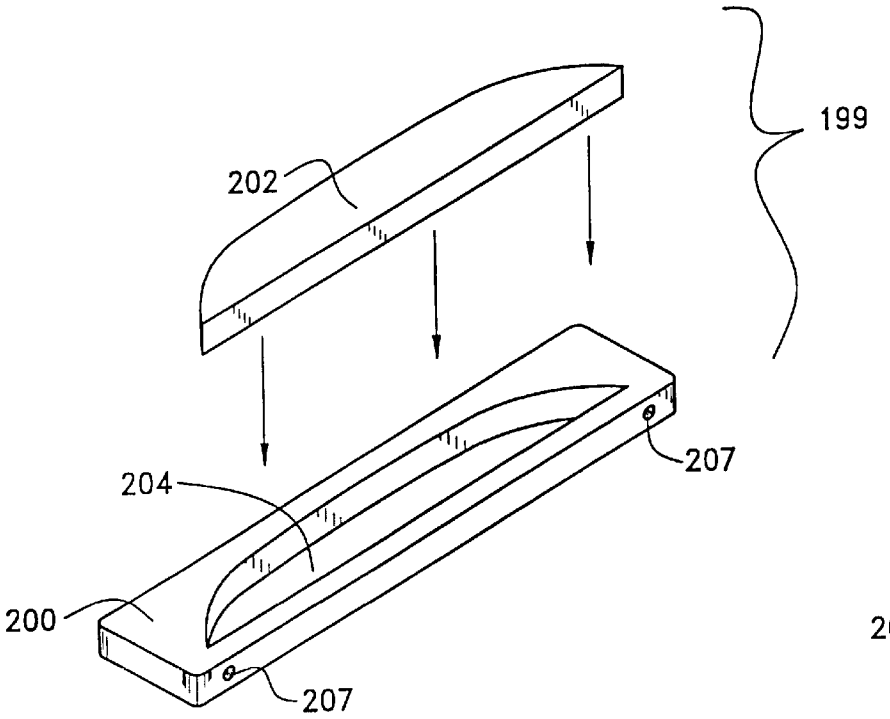
FIG. 4A is an exploded perspective view of a multi-piece lace guide member.

As an alternative to the previously described tubular guide members, the guide members 50 and/or 52 comprise a multi-piece guide member 199 comprised of a first member 200 and a second member 202 that mates thereto, such as shown in FIGS. 4A and 4B. The first member 200 and the second member 202 each have a thin, flat shape. A cavity or seat 204 (FIG. 4A) extends into an upper surface of the first member 200. The seat 204 is preferably sized to receive the second member 202 snug therein, such as in a press-fit fashion, as best shown in FIG. 4B.

Figure 5:
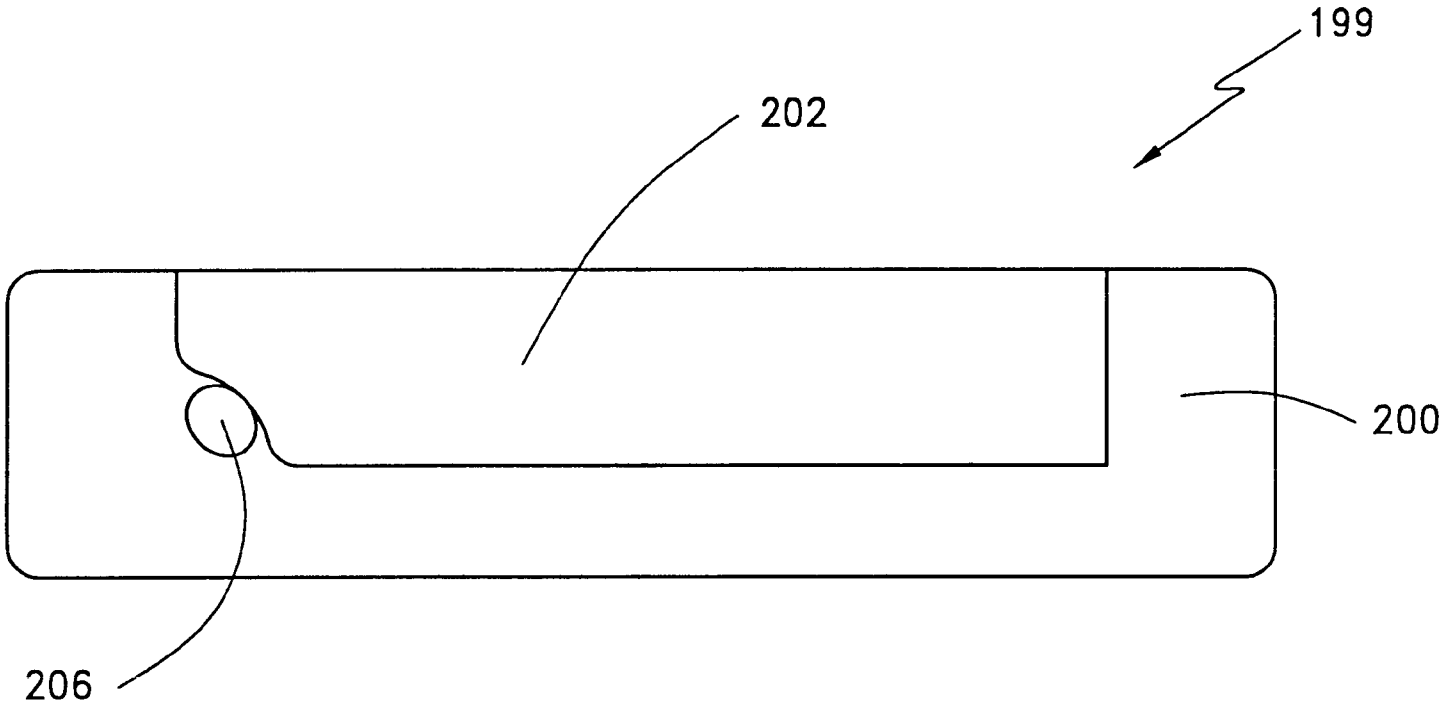
FIG. 5 is a cross-sectional view of the multi-piece guide member of FIG. 4 along line 5—5.

As shown in the cross-sectional view of FIG. 5, the second member 202 may be positioned within the seat so that a gap 206 of predetermined shape is defined between the second member 202 and the first member 200. A pair of apertures 207 (FIGS. 4A, 4B) are located on one of the first or second member 202, 204 to serve as entryways into the gap 206. The apertures 207 preferably are sufficiently large to allow passage of the lace 23 therethrough. In one embodiment, the apertures 207 are within the range of from about 0.030 inches to about 0.060 inches in diameter.

Figure 6:
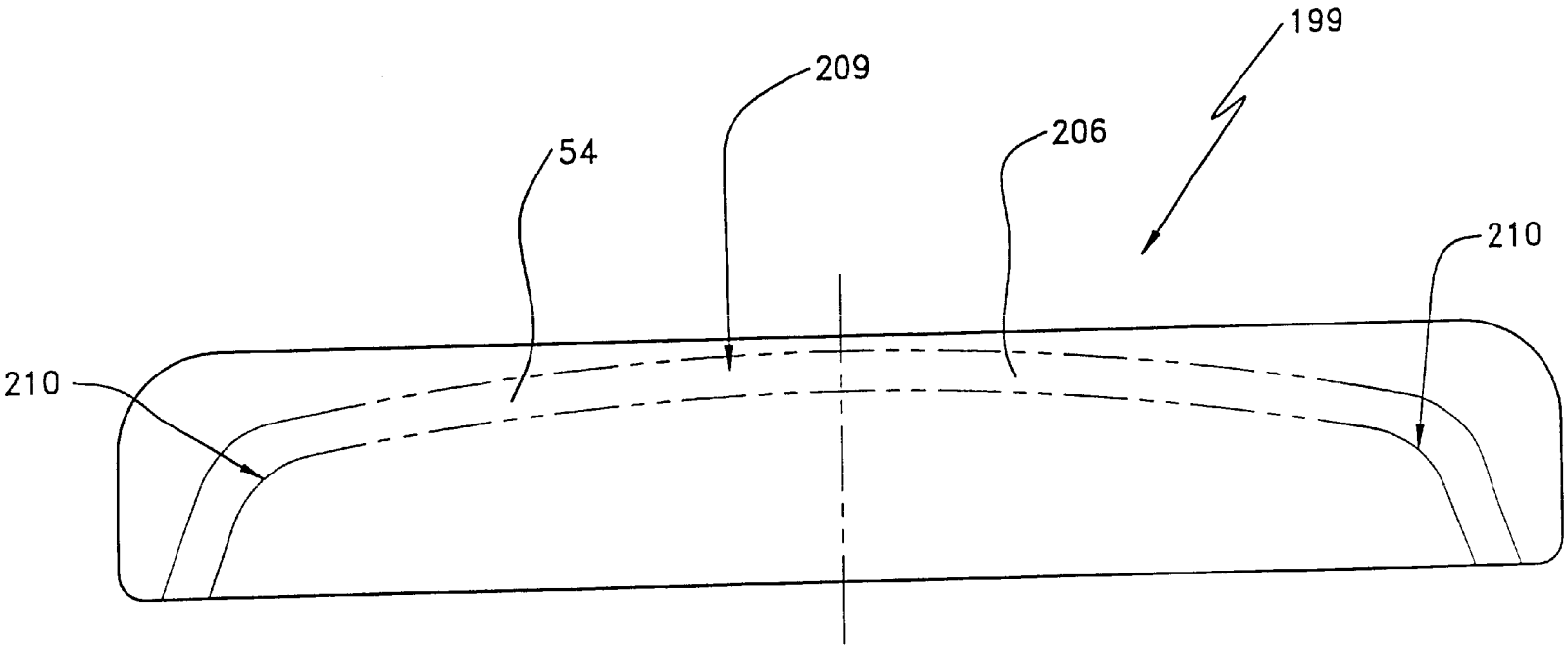
FIG. 6 is a top plan view of the multi-piece guide member.

With reference to FIG. 6, the gap 206 is elongated so that it defines a lace pathway that functions as the lumen 54 for the lace 23. The lumen 54 preferably includes an elongate region 209 that extends generally lengthwise along the edges of the flaps 32 or 34 when the guide member 199 is mounted on the boot. The elongate region 209 may be straight or may be defined by a smooth curve along the length thereof, such as a continuous portion of a circle or ellipse. As an example, the elongate region 209 may be defined by a portion of an ellipse having a major axis of about 0.5 inches to about 2 inches and a minor axis of about 0.25 inches to about 1.5 inches. In one embodiment, the major axis is approximately 1.4 inches and the minor axis is about 0.5 inches. The lumen 54 further includes a transverse region 210 on opposite ends of the elongate region 209. The transverse region 210 extends at an incline to the edges of the flaps 32 and 34. Alternatively, the elongate region 209 and the transverse region 210 may be merged into one region having a continuous circular or elliptical profile to spread load evenly along the length of the lumen 54 and thereby reduce total friction in the system. The first and second members 200, 202 of the multi-piece guide member 199 may be manufactured of a low friction material, such as a lubricous polymer or metal, that facilitates the slideability of the lace 23 therethrough. Alternatively, the guide member 199 can be made from any convenient substantially rigid material, and then be provided with a lubricous coating on at least the surface of the inside curve of lumen 54 to enhance slideability. The guide member 199 may be substantially rigid to prevent bending and kinking of the guide member 199 and/or the lace 23 therein as the lace 23 is tightened. The guide member 199 may alternatively be made of a flexible material when used in portions of the shoe that are subject to bending. The guide members 50, 52 may be manufactured through known molding processes.

The lace 23 may be formed from any of a wide variety of polymeric or metal materials or combinations thereof, which exhibit sufficient axial strength and bendability for the present application. For example, any of a wide variety of solid core wires, solid core polymers, or multi-filament wires or polymers, which may be woven, braided, twisted or otherwise oriented can be used. A solid or multi-filament metal core can be provided with a polymeric coating, such as PTFE or others known in the art, to reduce friction. In one embodiment, the lace 23 comprises a stranded cable, such as a 7 strand by 7 strand cable manufactured of stainless steel. In order to reduce friction between the lace 23 and the guide members 50, 52 through which the lace 23 slides, the outer surface of the lace 23 is preferably coated with a lubricous material, such as nylon or Teflon. In a preferred embodiment, the diameter of the lace 23 ranges from 0.024 inches to 0.060 inches and is preferably 0.027 inches. The lace 23 is desirably strong enough to withstand loads of at least 40 pounds and preferably loads up to 90 pounds. A lace 23 of at least five feet in length is suitable for most footwear sizes, although smaller or larger lengths could be used depending upon the lacing system design.

The lace 23 may be formed by cutting a piece of cable to the desired length. If the lace 23 comprises a braided or stranded cable, there may be a tendency for the individual strands to separate at the ends or tips of the lace 23, thereby making it difficult to thread the lace 23 through the openings in the guide members 50, 52. As the lace 23 is fed through the guide members, the strands of the lace 23 easily catch on the curved surfaces within the lace guide members. The use of a metallic lace, in which the ends of the strands are typically extremely sharp, also increases the likelihood of the cable catching on the guide members during threading. As the tips of the strands catch on the guide members and/or the tightening mechanism, the strands separate, making it difficult or impossible for the user to continue to thread the lace 23 through the tiny holes in the guide members and/or the tightening mechanism. Unfortunately, unstranding of the cable is a problem unique to the present replaceable-lace system, where the user may be required to periodically thread the lace through the lace guide members and into the corresponding tightening mechanism.

Figure 7:
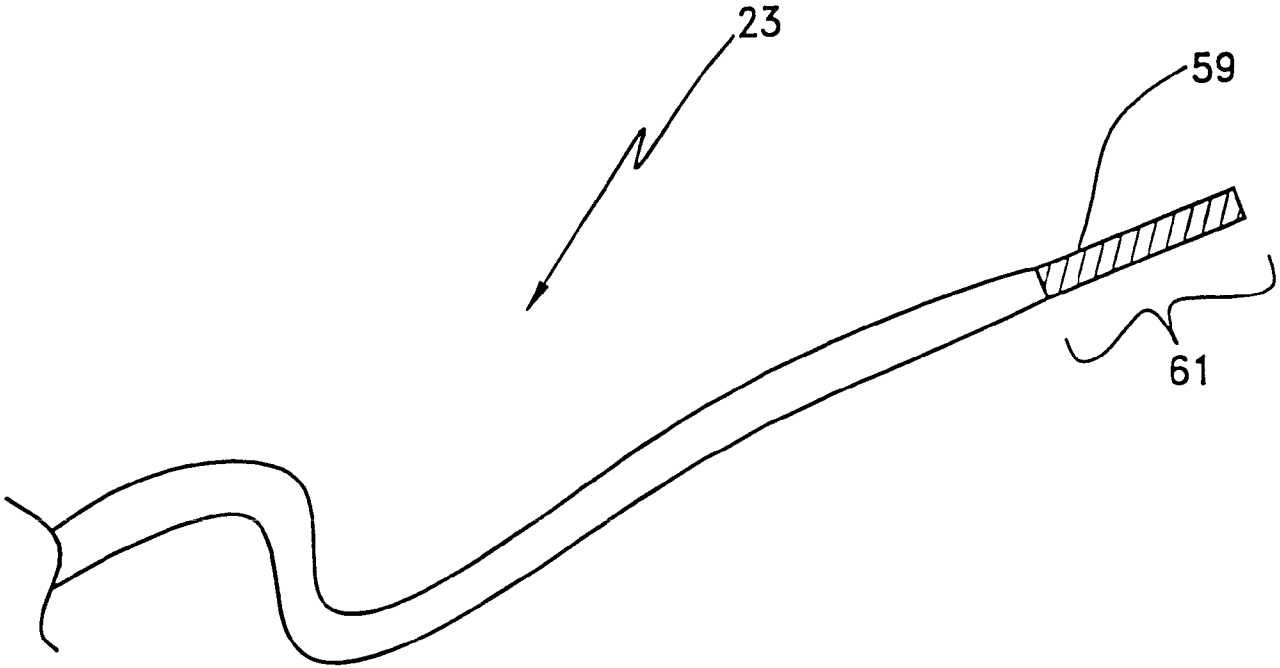
FIG. 7 is a perspective view of an end portion of a lace having a welded tip.

With reference to FIG. 7, one solution to this problem is to provide the tips or ends 59 of the lace 23 with a sealed or bonded region 61 wherein the individual strands are retained together to prevent separation of the strands from one another. For clarity of illustration, the bonded region 61 is shown having an elongate length. However, the bonded region 61 may also be a bead located at just the extreme tip of the lace 23 and, in one embodiment, could be a bonded tip surface as short as 0.002 inch or less.

The bonded region 61 may be formed, for example, by applying a weld (e.g., solder tip, brazing, welding, or melting the strands together) to the ends 59 during formation of the lace 23 to thereby hold the strands together and prevent separation of the strands. A tip weld advantageously does not significantly increase the overall diameter of the lace 23. Additionally, the weld may also be used to smooth the ends 59 of the lace 23 to facilitate insertion of the lace 23 into the guide members. A weld is also advantageous in that it provides a secure, permanent bond between the strands of the lace 23. The bonded region 61 provides the ends of the lace 23 with a smooth and secure surface that greatly facilitates threading of the lace through the guide members and into the tightening mechanism. The bonded region thus makes it much easier for a user to replace the lace 23 in the system. Alternatively, adhesives or thin walled shrink wrap tubing may be used in certain embodiments.

As shown in FIG. 3, the tightening mechanism 25 is mounted to the rear of the upper 24 by fasteners 64. Although the tightening mechanism 25 is shown mounted to the rear of the boot 20, it is understood that the tightening mechanism 25 could be located at any of a wide variety of locations on the boot 20. In the case of an ice skating boot, the tightening mechanism is preferably positioned over a top portion of the tongue 36. The tightening mechanism 25 may alternatively be located on the bottom of the heal of the boot, on the medial or the lateral sides of the upper or sole, as well as anywhere along the midline of the shoe facing forward or upward. Location of the tightening mechanism 25 may be optimized in view of a variety of considerations, such as overall boot design as well as the intended use of the boot. The shape and overall volume of the tightening mechanism 25 can be varied widely, depending upon the gear train design, and the desired end use and location on the boot. A relatively low profile tightening mechanism 25 is generally preferred. The mounted profile of the tightening mechanism 25 can be further reduced by recessing the tightening mechanism 25 into the wall or tongue of the boot. Boots for many applications have a relatively thick wall, such as due to structural support and/or thermal insulation and comfort requirements. The tightening mechanism may be recessed into the wall of the boot by as much as ¾" or more in some locations and for some boots, or on the order of about ⅛" or ½ for other location and/or other boots, without adversely impacting the comfort and functionality of the boot.

In general, the tightening mechanism 25 comprises a control such as a lever, crank or knob, which can be manipulated to retract lace 23 therein. In addition, the tightening mechanism preferably comprises a release such as a button or lever, for disengaging the tightening mechanism to permit the lace 23 to be withdrawn freely therefrom.

The tightening mechanism 25 in the illustrated embodiment generally comprises a rectangular housing 60 and a circular knob 62 rotatably mounted thereto. The knob 62 may be rotated to wind the ends of the lace 23 into the housing 60 and thereby tension the lace 23 to reduce slack. As the slack in the lace 23 reduces, the lace 23 pulls the side guide members 50, and thereby the flaps 32 and 34, toward the midline of the boot to tighten the upper 24 around a foot.

The tightening mechanism 25 advantageously includes an internal gear mechanism to allow the wearer to easily turn the knob 62 to retract the lace 23. Preferably, the gear mechanism is configured to incrementally pull and retain a predetermined length of lace as the knob 62 is rotated, as described in detail below. A user may thus advantageously continuously adjust the tension in the lace 23 to a desired comfort and performance level. The knob 62 may be rotated either manually or through the use of a tool or small motor attached to the knob 62.

Any of a variety of known mechanical structures can be utilized to permit winding of the spool to increase tension on the lace, yet resist unwinding of the spool until desired. For example, any of a wide variety of ratchet structures can be used for this purpose. Alternatively, a sprague clutch or similar structure will permit one-way rotation of a shaft while resisting rotation in the opposite direction. These and other structures will be well known to those of ordinary skill in the mechanical arts.

A release lever 63 is located along a side of the housing 60. The release lever may be rotated to disengage the internal gear mechanism to release tension in the lace 23 and loosen the upper 23 around the wearer's foot, as described in detail below. This advantageously allows a user to quickly and easily untighten the lacing system by simply turning the release lever 63.

The low friction relationship between the lace 23 and cable guides 50, 52 greatly facilitate tightening and untightening of the lacing system 20. Specifically, because the lace 23 and cable guides 50 and 52 are manufactured or coated with a low friction material, the lace 23 slides easily through the cable guides without catching. The lace 23 thus automatically distributes the tension across its entire length so that tightening pressure is evenly distributed along the length of the ankle and foot. When the tension in the lace 23 is released by actuating the release lever, the lace 23 slides easily through the cable guides 50 and 52 to release tension and evenly distribute any slack among the length of the lace. The low friction tongue 36 also facilitates moving of the flaps 32, 34 away from each other when the lace 23 is loosened.

Figure 8:
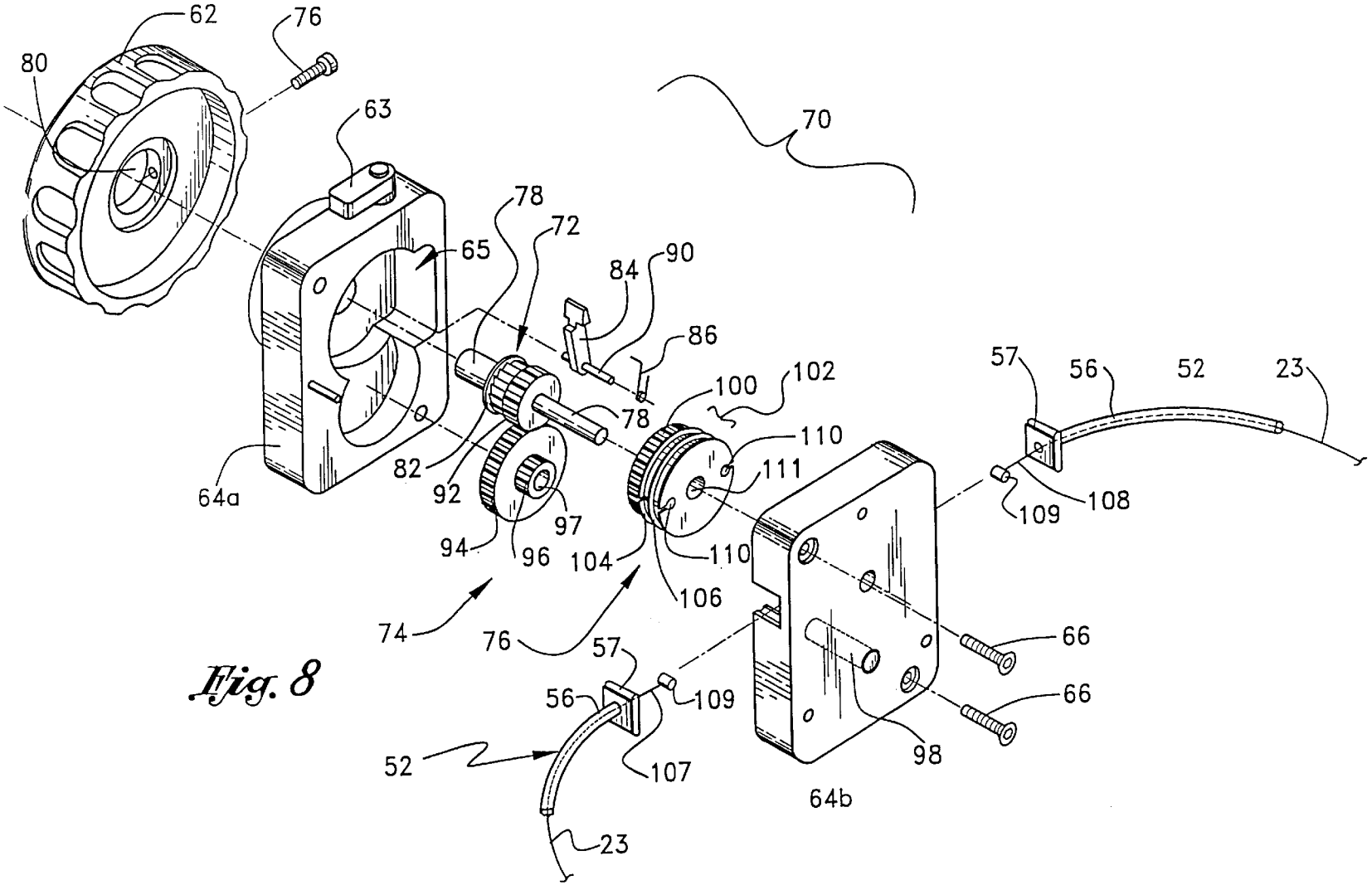
FIG. 8 is an exploded perspective view of one embodiment of a tightening mechanism used with the lacing system described herein.

FIG. 8 is an exploded perspective view of the various components of one embodiment of the tightening mechanism 25. As shown, the housing 60 consists of a pair of interlocking halves 64*a* and 64*b* that are mated to each other using fasteners 66, such as screws. The housing 60 encloses a gear mechanism 70 that preferably rotatably fits within cavities 65 in the inner surfaces of the halves 64*a* and 64*b*. In the illustrated embodiment, the gear mechanism 70 comprises first, second, and third gear wheels 72, 74, and 76, respectively, that rotatably engage with each other when the tightening mechanisms 25 is assembled.

As shown in FIG. 8, the first gear wheel 72 includes a shaft 78 about which the first gear wheel rotates. A first portion of the shaft 78 extends through an aperture in the housing halve 64*a*. A second portion of the shaft 78 extends through an aperture in the halve 64*b*. The knob 62 mounts to the shaft 78 through a mounting hole 80 in the knob 62. A mounting pin 76 removably secures the knob 62 to the shaft 78 in a well known manner. When the tightening mechanism 25 is assembled, rotation of the knob 62 causes the first gear wheel 72 to also rotate. Actuation of the gear mechanism 70 is thus accomplished through rotation of the knob 62.

Referring to FIG. 8, the first gear wheel 72 also includes a ratchet section 82 having a plurality of sloped teeth 83 (FIG. 10) positioned circumferentially around the axis of the first gear wheel 72. The sloped teeth 83 are configured to mate with a pawl 84 to prevent undesired backward rotation of the first gear wheel 72, as described more fully below. Toward this end, a biasing member 86 couples to a peg 90 that extends from the pawl 84. The biasing member 86 biases the pawl 84 against the ratchet teeth when the gear mechanism 70 is assembled. The third gear wheel 72 also includes a gear section 92 having a series of gear teeth that extend around the periphery of the third gear wheel 72.

As shown in FIG. 8, the second gear wheel 74 includes a first gear section 94 and a stepped second gear section 96 having a diameter smaller than the first gear section 94 on a common axis of rotation. The first gear section 94 has gear teeth that are configured to mesh with the gear section 92 of the first gear wheel 72. An aperture 97 extends centrally through the second gear wheel 74. The aperture 97 is sized to rotatably receive a post 98 that extends from the housing halve 64*b*. The second gear wheel 74 rotates about the post 98 during actuation of the assembled gear mechanism 70.

Referring to FIG. 8, the third gear wheel 76 includes a gear section 100 that is configured to mesh with the second gear section 96 of the second gear wheel 74. The third gear wheel also includes a spool section 102 comprising grooves 104, 106 that extend around the periphery of the third gear wheel 76. The grooves 104, 106 are sized to receive opposite ends of the lace 23 in a winding fashion during actuation of the gear mechanism 25.

The ends 107 and 108 of the lace 23 are each provided with anchors 109 that mate with seating holes 110 in a press fit fashion. The seating holes 110 are diametrically positioned on the third gear wheel 76. When the anchors 109 are mated with the seating holes 110, the ends 107 and 108 of the lace 23 are separately positioned within the grooves 104 and 106, respectively. The coupling mounts 57 fit into a corresponding aperture in the housing halve 64 to maintain the distal ends 56 of the guide member 50 in a fixed position relative to the tightening mechanism.

Any of a variety of spool or reel designs can be utilized in the context of the present invention, as will be apparent to those of skill in the art in view of the disclosure herein. For example, only a single groove spool can be utilized. However, a dual groove spool or two side-by-side spools as illustrated has the advantage of permitting convenient simultaneous retraction of both lace ends 107 and 108. In the illustrated embodiment, with ends 107 and 108 approaching the spool from opposite directions, the lace conveniently wraps around the spool in opposite directions using a single rotatable shaft as will be apparent from FIG. 8.

Depending upon the gearing ratio and desired performance, one end of the lace can be fixed to a guide or other portion of the boot and the other end is wound around the spool. Alternatively, both ends of the lace can be fixed to the boot, such as near the toe region and a middle section of the lace is attached to the spool.

Preferably, the cavity 65 is toleranced to fit closely around the outer circumference of the spool, to capture the lace. Thus, the gap between the outer flange walls surrounding each groove and the interior surface of the cavity 65 are preferably smaller than the diameter of the lace. In this manner, the risk of tangling the lace within the winding mechanism can be minimized.

Any of a variety of attachment structures for attaching the ends of the lace to the spool can be used. In addition to the illustrated embodiment, the lace may conveniently be attached to the spool by threading the lace through an aperture and providing a transversely oriented set screw so that the set screw can be tightened against the lace and to attach the lace to the spool. The use of set screws or other releasable clamping structures facilitates disassembly and reassembly of the device, and replacement of the lace as will be apparent to those of skill in the art.

Rotation of the third gear wheel 76 causes the ends 107 and 108 of the lace 23 to wind around the grooves 104 and 106, respectively, and thereby pull the length of the lace 23 into the tightening mechanism 25 and place the lace 23 in tension. It is understood that the ends 107, 108 of the lace 23 wind around the spool section 102 at an equal rate so that tension is evenly applied to both ends of the lace 23.

The third gear wheel includes a central aperture 111 sized to rotatably receive the shaft 78 on the first gear wheel 72. The third gear wheel 76 rotates about the shaft 78 during actuation of the gear mechanism 70.

In a preferred embodiment, the third gear wheel 76 has a diameter of 0.625 inches. The second gear section 96 of the second gear wheel 74 preferably has a diameter of approximately 0.31 inches and the first gear section preferably has a diameter approximately equal to the diameter of the third gear wheel 76. The first gear wheel 72 preferably has a diameter of approximately 0.31 inches. Such a relationship in the gear sizes provides sufficiently small adjustments in the tension of the lace 23 as the gear wheels are turned.

Figure 9:
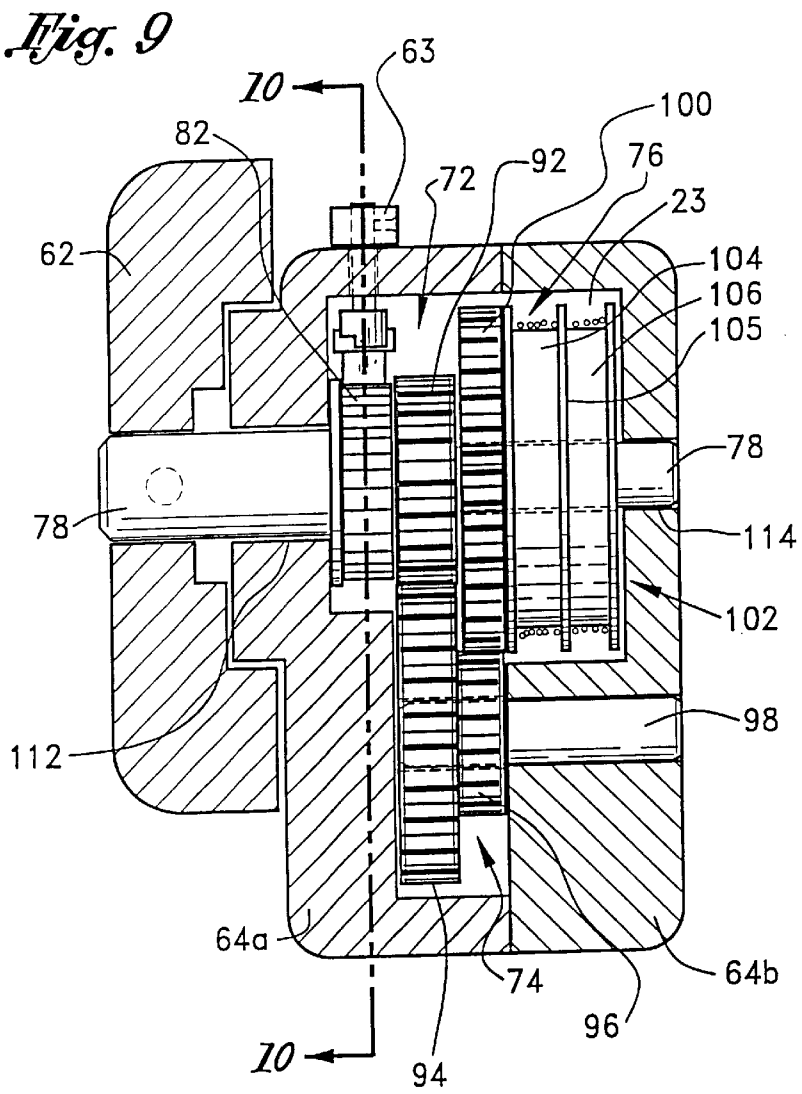
FIG. 9 is a cross-sectional side view of the assembled tightening mechanism of FIG. 8.

FIG. 9 illustrates a cross-sectional view of the assembled tightening mechanism 25. As shown, the shaft 78 of the first gear wheel 72 is journaled within apertures 112 and 114 in the housing halves 64*a* and 64*b*, respectively. The knob 62 is mounted over the portion of the shaft 78 extending out of the halve 64*a* through the aperture 112. The first, second, and third gear wheels 72, 74, and 76, respectively are in meshed engagement with each other. Specifically, the gear section 92 of the first gear wheel 72 is in meshed engagement with the first gear section 94 on the second gear wheel. Likewise, the second gear section 96 on the second gear wheel 94 is in meshed engagement with the gear section 100 of the third gear wheel 76. Accordingly, rotation of the knob 62 causes the first gear wheel 72 to rotate and thereby cause the second gear wheel to rotate in an opposite direction by means of the meshed engagement between the gear sections 92 and 94. This in turn causes the third gear wheel 76 to rotate in the direction of knob rotation by means of the meshed engagement between the gear sections 96 and 100.

As the third gear wheel 76 rotates, the ends 107 and 108 of the lace are wound within the grooves 104 and 106 respectively. Rotation of the knob 62 thus winds the lace 23 around the third gear wheel 76 to thereby tighten the boot 20.

As illustrated, counterclockwise rotation (relative to FIG. 10) of the knob 62 tightens the lace 23. The tension in the lace 23 is maintained by means of a ratchet mechanism that is described with reference to FIG. 10.

Figure 10:
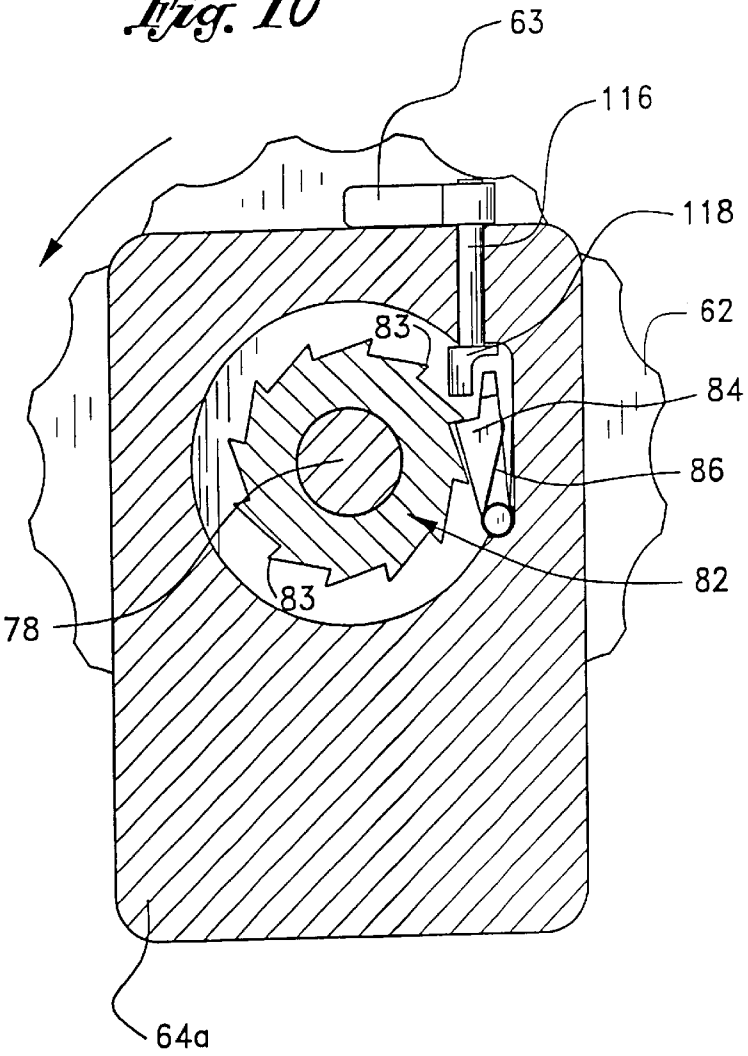
FIG. 10 is a cross-sectional view of the tightening mechanism of FIG. 9 taken along the line 10—10.

FIG. 10 is a cross-sectional view of the tightening mechanism 25 taken along the line 10—10 of FIG. 9. As shown, the biasing member 86 maintains the pawl 84 in locked engagement with the sloped teeth 83 on the ratchet section 82. The pawl 84 thus inhibits clockwise rotation of the knob 62 and loosening of the lace 23. It will be understood that the sloped teeth 83 do not inhibit counterclockwise rotation of the knob 62 because the pawl 84 slides over the teeth 83 when the knob 64 is rotated clockwise. As the knob 62 is rotated counterclockwise, the pawl 84 automatically engages each of the teeth 83 to advantageously allow the user to incrementally adjust the amount of lace 23 that is drawn into the tightening mechanism 25.

As shown in FIG. 10, the release lever 63 communicates with the pawl 84 through a shaft 116 that extends through the housing 60. A lower end of the shaft 116 is provided with a cam member 118. The release lever 63 may be rotated about the shaft 116 to cause the cam member 118 to also rotate and push the pawl 84 away from engagement with the ratchet teeth 83. When the pawl 84 disengages from the ratchet teeth, the first gear wheel 72, and each of the other gear wheels 74 and 76, are free to rotate.

When the user actuates the release lever 63, the tension, if any, in the lace 23 causes the lace 23 to automatically unwind from the spooling section 102. The release lever 63 is thus used to quickly untighten the boot 20 from around the foot. It will be appreciated that the low friction relationship between the lace 23 and the guide members 50 and 52 facilitates sliding of the lace 23 within the guide members so that the lace untightens quickly and smoothly by simply turning the release lever 63 and then manually pulling the tongue 36 forward.

It is contemplated that a limit on the expansion of portions of the boot due to the sliding of the lace 23 could be accomplished such as through one or more straps that extend transversely across the boot 20 at locations where an expansion limit or increased tightness or support are desired. For instance, a strap could extend across the instep portion 30 from one side of the boot 20 to another side of the boot. A second or lone strap could also extend around the ankle portion 29.

Figure 11:
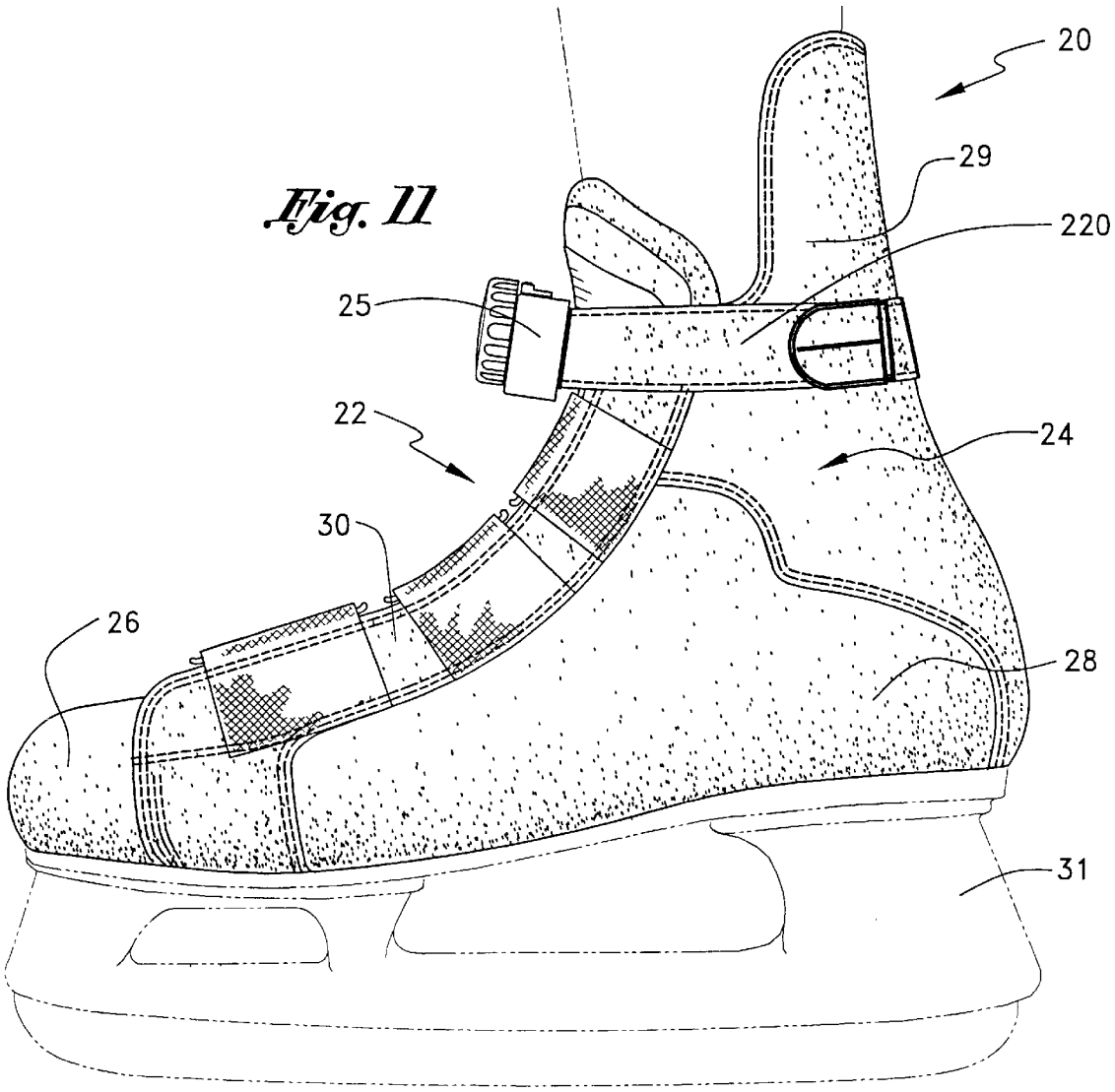
FIG. 11 is a side view of the sport boot including an ankle support strap.

With reference to FIG. 11, an expansion limiting strap 220 is located on the ankle portion of the boot 20 to supplement the closure provided by the lace 23 and provide a customizable limit on expansion due to the dynamic fit achieved by the lacing system of the present invention. The limit strap 220 may also prevent or inhibit the wearer's foot from unintentionally exiting the boot 20 if the lace 20 is unlocked or severed or the reel fails. In the illustrated embodiment, the strap 220 extends around the ankle of the wearer. The location of the limit strap 220 can be varied depending upon boot design and the types of forces encountered by the boot in a particular athletic activity.

For example, in the illustrated embodiment, the limit strap 220 defines an expansion limiting plane which extends generally horizontally and transverse to the wearer's ankle or lower leg. The inside diameter or cross section of the footwear thus cannot exceed a certain (valve) in the expansion limiting plane, despite forces imparted by the wearer and the otherwise dynamic fit. The illustrated location tends to limit the dynamic opening of the top of the boot as the wearer bends forward at the ankle. The function of the limit strap 220 may be accomplished by on or more straps, wires, laces or other structures which encircle the ankle, or which are coupled to other boot components such that the limit strap in combination with the adjacent boot components provide an expansion limiting plane.

In an alternative design, the expansion limiting plane is positioned in a generally vertical orientation, such as by positioning the limit strap 220 across the top of the foot anterior of the ankle, to achieve a different limit on dynamic fit. In this location, the expansion limiting strap 220 may encircle the foot inside or outside of the adjacent shoe components, or may connect to the sole or other component of the shoe to provide the same net force effect as though the strap encircled the foot.

The limit strap 220 may also create a force limiting plane which resides at an angle in between the vertical and horizontal embodiments discussed above, such as in an embodiment where the force limiting plane inclines upwardly from the posterior to the anterior within the range of from about 25° to about 75° from the plane on which the sole of the boot resides. Positioning the limit strap 220 along an inclined force limiting plane which extends approximately through the ankle can conveniently provide both a limit on upward movement of the foot within the boot, as well as provide a controllable limit on the anterior flexing of the leg at the ankle with respect to the boot.

The strap 220 preferably includes a fastener (222) that could be used to adjust and maintain the tightness of the strap 220. Preferably, the fastener 222 is capable of quick attachment and release, so that the wearer can adjust the limit strap 220 without complication. Any of a variety of fasteners such as corresponding hook and loop (e.g., Velcro) surfaces, snaps, clamps, cam locks, laces with knots and the like may be utilized, as will be apparent to those of skill in the art in view of the disclosure herein.

The strap 220 is particularly useful in the present low-friction system. Because the lace 23 slides easily through the guide members, the tension in the lace may suddenly release if the lace is severed or the reel fails. This would cause the boot to suddenly and completely open which could cause injury to the wearer of the boot, especially if they were involved in an active sport at the time of failure. This problem is not present in traditional lacing systems, where the relatively high friction in the lace, combined with the tendency of the lace to wedge with the traditional eyelets on the shoe, eliminates the possibility of the lace suddenly and completely loosening.

The low-friction characteristics of the present system also provides the shoe with a dynamic fit around the wearer's foot. The wearer's foot tends to constantly move and change orientation during use, especially during active sports. This shifting causes the tongue and flaps of the shoe to shift in response to the movement of the foot. This is facilitated by the low-friction lacing system, which easily equilibrates the tension in the lace in response to shifting of the wearer's foot. The strap 220 allows the user to regulate the amount of dynamic fit provided by the boot by establishing an outer limit on the expansion which would otherwise have occurred due to the tension balancing automatically accomplished by the readjustment of the lace throughout the lace guide system.

For example, if the wearer of the boot in FIG. 11 did not have the ankle strap 220, when he flexed his ankle forward during skating, the increased forward force at the top of the boot would cause the tongue to move out slightly while the laces lower in the boot would tighten. As the wearer straightened his ankle out again, closure force would equalize and the tongue would stay tight against his ankle. If the strap 220 were wrapped around his ankle however, it would prevent or reduce this forward movement of the ankle and tongue reducing the dynamic fit characteristics of the boot in the plane of the strap 220 and providing a very different fit and feel of the boot. Thus, the strap provides an effective means for regulating the amount of dynamic fit inherent in the low friction closure system. Since traditional lacing systems have so much friction in them, they do not provide this dynamic fit and consequently would not benefit from the strap in the same way.

Similar straps are commonly used in conjunction with traditional lacing systems but for entirely different reasons. They are used to provide additional closure force and leverage to supplement shoelaces but are not needed for safety and are not used to regulate dynamic fit.

The footwear lacing system 20 described herein advantageously allows a user to incrementally tighten the boot 20 around the user's foot. The low friction lace 23 combined with the low friction guide members 50, 52 produce easy sliding of lace 23 within the guide members 50 and 52. The low friction tongue 36 facilitates opening and closure of the flaps 32 and 34 as the lace is tightened. The lace 23 equilibrates tension along its length so that the lacing system 23 provides an even distribution of tightening pressure across the foot. The tightening pressure may be incrementally adjusted by turning the knob on the tightening mechanism 25. A user may quickly untighten the boot 20 by simply turning the release lever 63 or lifting or pressing the knob or operating any alternative release mechanism to automatically release the lace 23 from the tightening mechanism 25.

Figure 12:
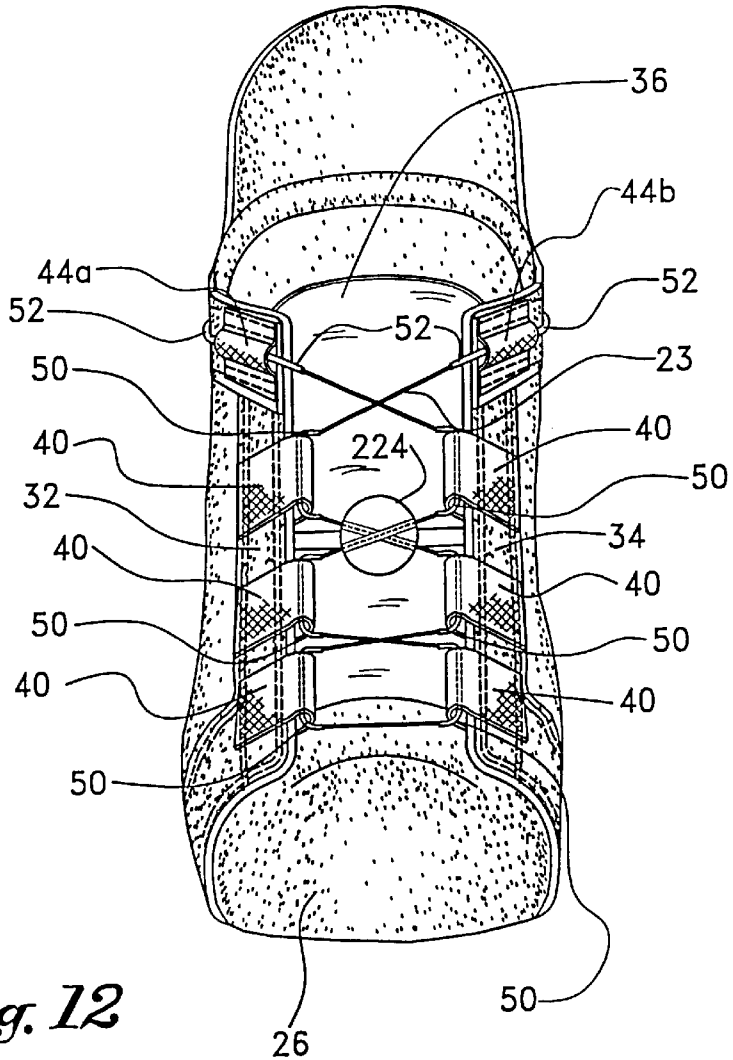
FIG. 12 is a front view of the sport boot including a central lace guide member disposed adjacent the tongue of the boot.
Figure 13:
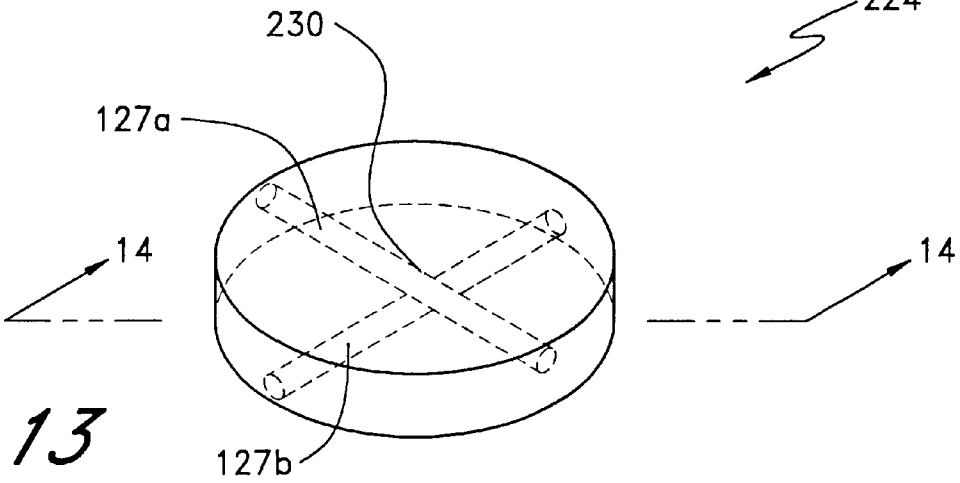
FIG. 13 is a perspective view of the central lace guide member.
Figure 14:
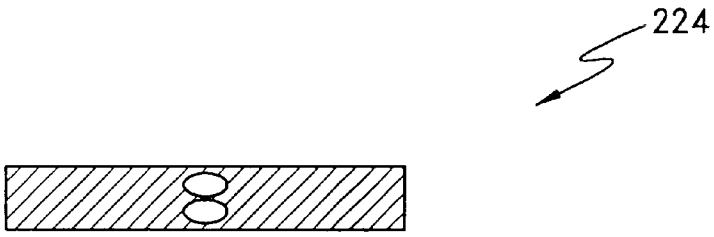
FIG. 14 is a cross-sectional view taken along the line 14—14 in FIG. 13.

As illustrated in FIG. 12, at least one anti-abrasion member 224 is disposed adjacent the tongue 36 and between the flaps 32, 34. As best shown in FIGS. 13, the anti-abrasion member 224 comprises a flat disc-like structure having a pair of internal channels or lumen 127*a,b* arranged in a crossing pattern so as to define a crossing point 230. The lumen 127*a,b* are sized to receive the lace 23 therethrough. As shown in the cross-sectional view of FIG. 14, the lumen 127*a,b* are arranged to prevent contact between adjacent sections of the lace 23 at the crossing point 230. The anti-abrasion member 224 thereby prevents chafing of the lace 23 at the crossing point 230. The anti-abrasion member 224 also shields the lace 23 from the tongue 36 to inhibit the lace 23 from chafing or abrading the tongue 36.

The anti-abrasion member 224 may alternatively take the form of a knife edge or apex for minimizing the contact area between the lace 23 and the anti-abrasion member 224. For example, at a crossing point where lace 23 crosses tongue 36, an axially extending (e.g. along the midline of the foot or ankle) ridge or edge may be provided in-between the boot tongue 36 and the lace 23. This anti-abrasion member 224 is preferably molded or otherwise formed from a lubricious plastic such as PTFE, or other material as can be determined through routine experimentation. The lace 23 crosses the apex so that crossing friction would be limited to a small contact area and over a lubricious surface rather than along the softer tongue material or through the length of a channel or lumen as in previous embodiments. Tapered sides of the anti-abrasion member 224 would ensure that the anti-abrasion member 224 stayed reasonably flexible as well as help distribute the downward load evenly laterally across the foot. The length along the midline of the foot would vary depending upon the boot design. It may be as short as one inch long or less and placed on the tongue just where the lace crossing are, or it may extend along the entire length of the tongue with the raised ridge or crossing edge more prominent in the areas where the lace crosses and less prominent where more flexibility is desired. The anti-abrasion member 224 may be formed integrally with or attached to the tongue or could float on top of the tongue as in previously described disks.

In one embodiment, the anti-abrasion member 224 is fixedly mounted on the tongue 36 using any of a wide variety of well known fasteners, such as rivets, screws, snaps, stitching, glue, etc. In another embodiment, the anti-abrasion member 224 is not attached to the tongue 36, but rather freely floats atop the tongue 36 and is held in place through its engagement with the lace 23. Alternatively, the anti-abrasion member 224 is integrally formed with the tongue 36, such as by threading a first portion of the lace 23 through the tongue, and the second, crossing portion of lace 23 over the outside surface of the tongue.

Figure 15:
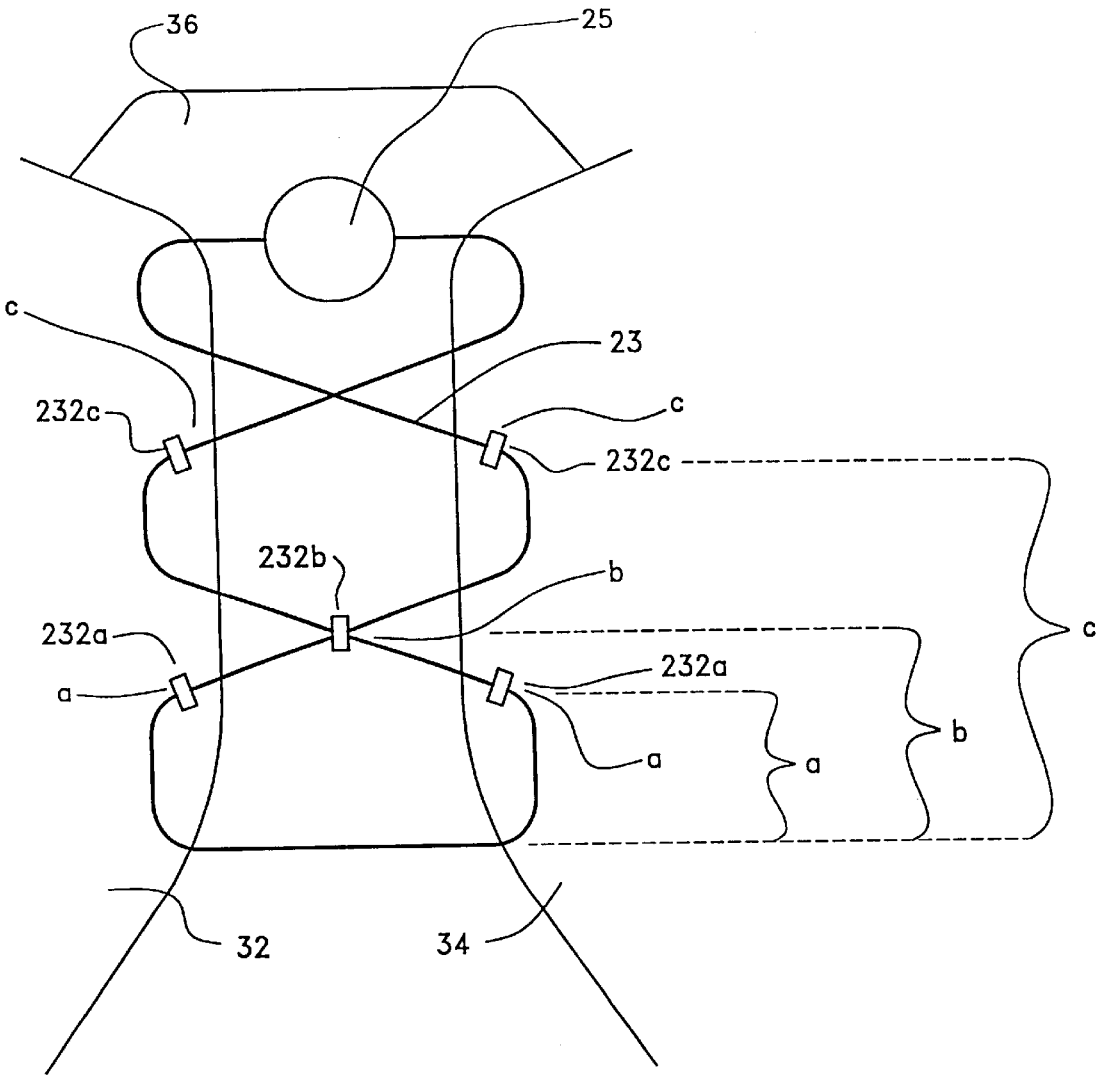
FIG. 15 is a schematic front view of the instep portion of the boot with a plurality of lace locking members disposed along the lace pathway.

FIG. 15 schematically illustrates a top view of the insole region of the boot 20. At least one lace locking member 232 (shown schematically) is disposed along the pathway of the lace 23. Each locking member 232 is configured to engage the lace 23 and prevent a predetermined portion of the lace from moving axially, such as toward the tightening mechanism 25 to thereby limit the tension of the lace in a predetermined region. For example, a pair of locking members 232*a* are located at points "a" along the lace pathway near the toe region of the flaps 32, 34. After tension has been applied to the lace 23 via the tightening mechanism 25, the locking members 232*a* may be engaged with the lace 23 to prevent movement of the lace in region "a". Once engaged, the locking members 232*a* secure the tension in the lace 23 in region "a" by locking the position of the lace 23 at points "a" with respect to the tightening mechanism 25. The lace tension in region "a" is thereby maintained even if the tension applied to the lace 23 by the tightening mechanism 25 is released or actuated. Thereafter, the tightening mechanism 25 may be released or actuated to apply a different level of tension or tightness in the lace outside of lace region "a".

With reference to FIG. 15, locking members 232 may be disposed at any of a wide variety of locations along the lace pathway, such as locations "b", and "c" to create various lace locking zones. By alternately locking and unlocking the locking members 232 and varying the tension in the lace 23, a user may provide zones of varied tightness along the lace pathway.

Figure 16:
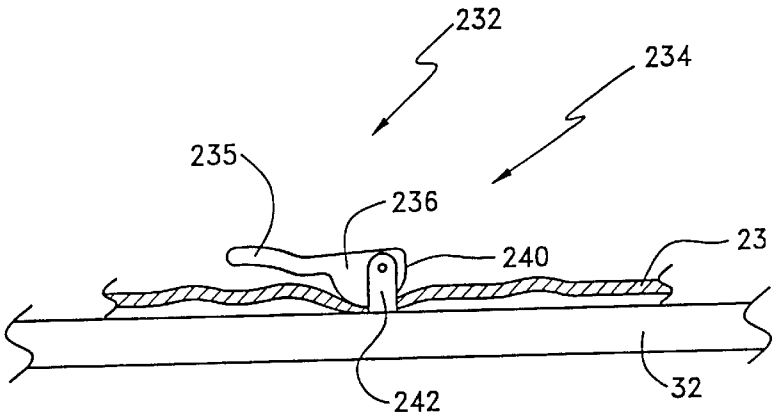
FIG. 16 is a side view of one embodiment of a lace locking member engaged with the boot lace.
Figure 17:
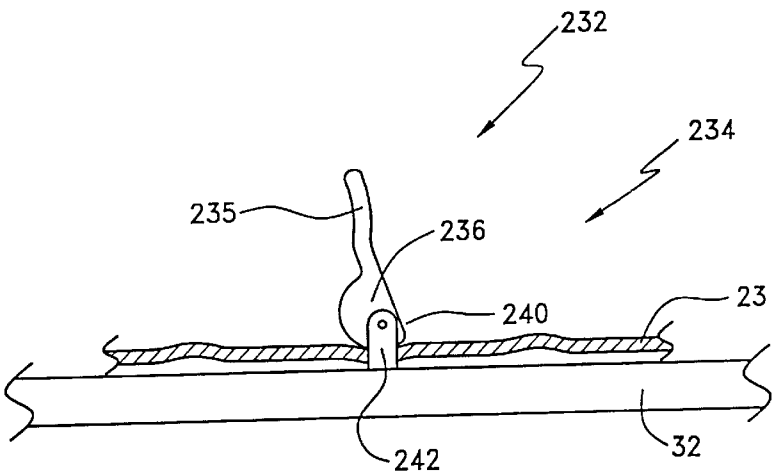
FIG. 17 is a side view of one embodiment of a lace locking member non-engaged with the boot lace.

FIGS. 16 and 17 show one embodiment of a locking member 232 that is coupled to the boot flap 32. The locking member 232 comprises an actuator 234 having an elongate arm 235 that extends outwardly from an enlarged cam portion 236 having a rounded bottom edge 240. The lace 23 is interposed between the rounded edge 240 of the cam portion 236 and the flap 32. The enlarged cam portion 236 of the actuator 234 is rotatably mounted to the flap 32, such as through a rotatable pin connector 242. As shown in FIG.

16, the actuator 234 may be moved to first or engaged position wherein the rounded edge 240 engages the lace 23 and applies a tightening force to secure the lace against the flap 32. The locking member 232 thereby prevents movement of the lace 23 relative to the shoe flap 32.

With reference to FIG. 17, the actuator 234 may also be moved to a second, non-engaged orientation wherein the rounded edge 240 of the cam portion 236 is removed from engagement with the lace 23 to thereby allow movement of the lace 23 relative to the flap 32.

Figure 19:
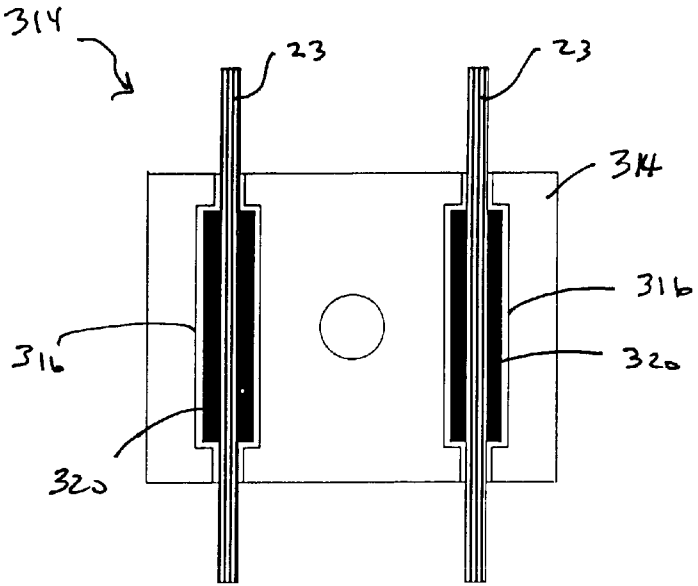
FIG. 19 is a top plan view of a first member portion of the lace locking member of FIG. 18.
Figure 18:
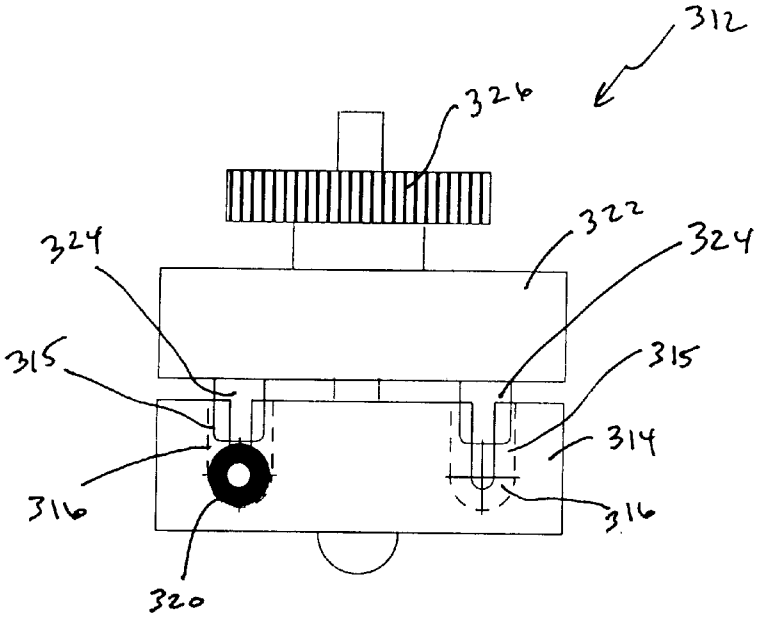
FIG. 18 is a side view of a second embodiment of the lace locking member.

FIG. 18 shows another embodiment of a lace locking member 312 comprised of a multi-piece structure including a first member 314 and a second member 322 coupled thereto. As best shown in the cross-sectional view of FIG. 19, the first member has a pair of shafts 316 extending therethrough. A pair of bore holes 315 (FIG. 18) in the first member 314 communicate with the shafts 316. An elongate tubular compression clamp 320 is located within each of the shafts 316. The shafts 316 and the compression clamps 320 are sized to receive the lace 23 therethrough, as shown in FIG. 19.

The second member 322 is movably coupled to the first member 314. The second member 322 includes a pair of pegs 324 that extend into the bore holes 315 in the first member 314. A screw 326 is coupled to the first member 314 and the second member 322. The second member 322 may be incrementally moved toward the first member 314 by turning the screw 326. As the screw 326 is turned, the pegs 324 incrementally slide into the lace shafts 316 and pinch or compress the compression clamps 320. When the lace is disposed within the compression clamps 320, the compression coupling between the pegs 324 and the compression clamps 320 is transferred to the lace 23 to inhibit the lace 23 from moving. The user may adjust the screw 326 to vary the level of compression that the pegs 324 apply to the lace 23.

The compression clamps 320 are preferably made of a soft, deformable material that will deform when the pegs 324 apply pressure thereto. Advantageously, the soft compression clamps 320 exert sufficient compression to the lace 23 with reduced risk of deformation to the lace 23. The locking member 312 may be disposed at various locations along the lace pathway to allow the user to create zones of varying tightness, as described previously.

As mentioned, the locking members 232 may be located at any of a wide variety of locations along the lace pathway to allow the user to fix the position of the lace 23 at any of these locations. Other mechanical or structural designs may be used to lock the lace relative to the tightening mechanism. For example, the entryways of the guide members may be fitted with a collect to engage the lace 23.

Figure 20:
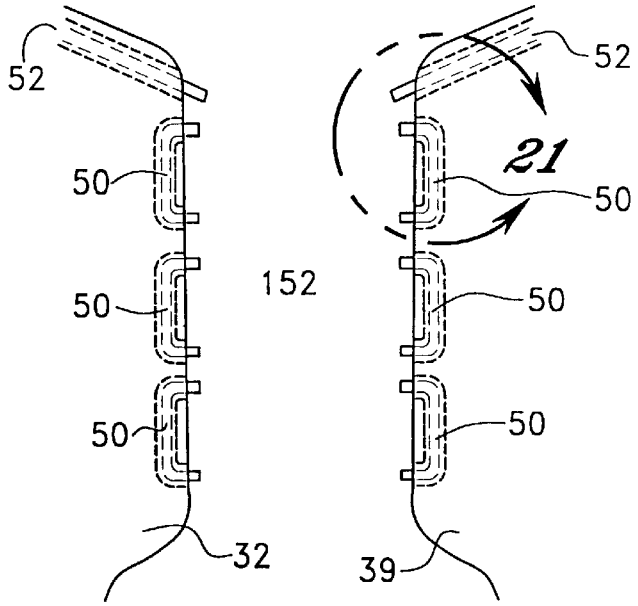
FIG. 20 is a front view of the instep portion of the boot.
Figure 21:
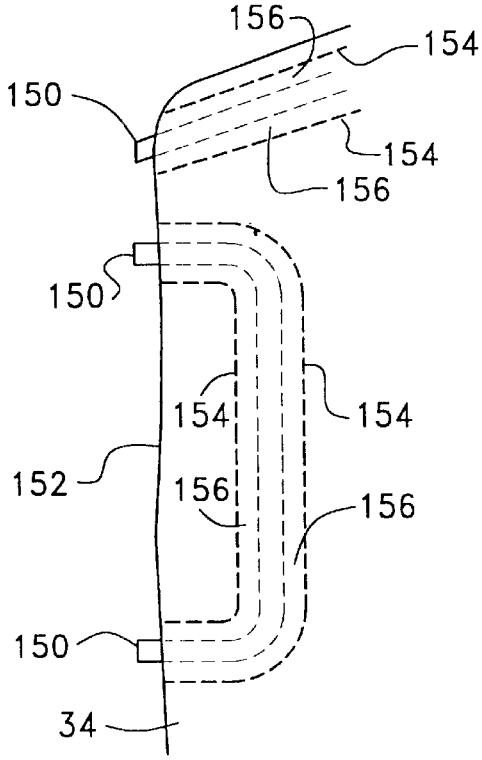
FIG. 21 is an enlarged view of the region within line 21 of FIG. 20.

FIG. 20 is a front view of the instep portion of the boot 20. In the embodiment shown in FIG. 20, the tubular guide members 50 and 52 are mounted directly within the flaps 32, 34, such as within or between single or multiple layers of material. Preferably, the tips 150 (FIG. 19) of each of the guide member 50, 52 protrude outwardly from an inner edge 152 of each of the flaps 32, 34. As best shown in FIG. 21, a set of stitches 154 surrounds each guide member 50 and 52. The stitches 154 are preferably positioned immediately adjacent the guide members 50, 52 to create a gap 156 therebetween. For ease of illustration, the gap 156 is shown having a relatively large size with respect to the diameter of the guide members 50, 52. However, the distance between each guide member 50, 52 and the respective stitches 154 is preferably small.

Preferably, each set of stitches 154 forms a pattern that closely matches the shape of the respective guide members so that the guide members 50, 52 fit snug within the flaps 32, 34. The stitches 154 thereby inhibit deformation of the guide members 50, 52, particularly the internal radius thereof, when the lace is tightened. Advantageously, the stitches also 154 function as anchors that inhibit the guide members 50, 52 from moving or shifting relative to the flaps 32, 34 during tightening of the lace.

Figure 22:
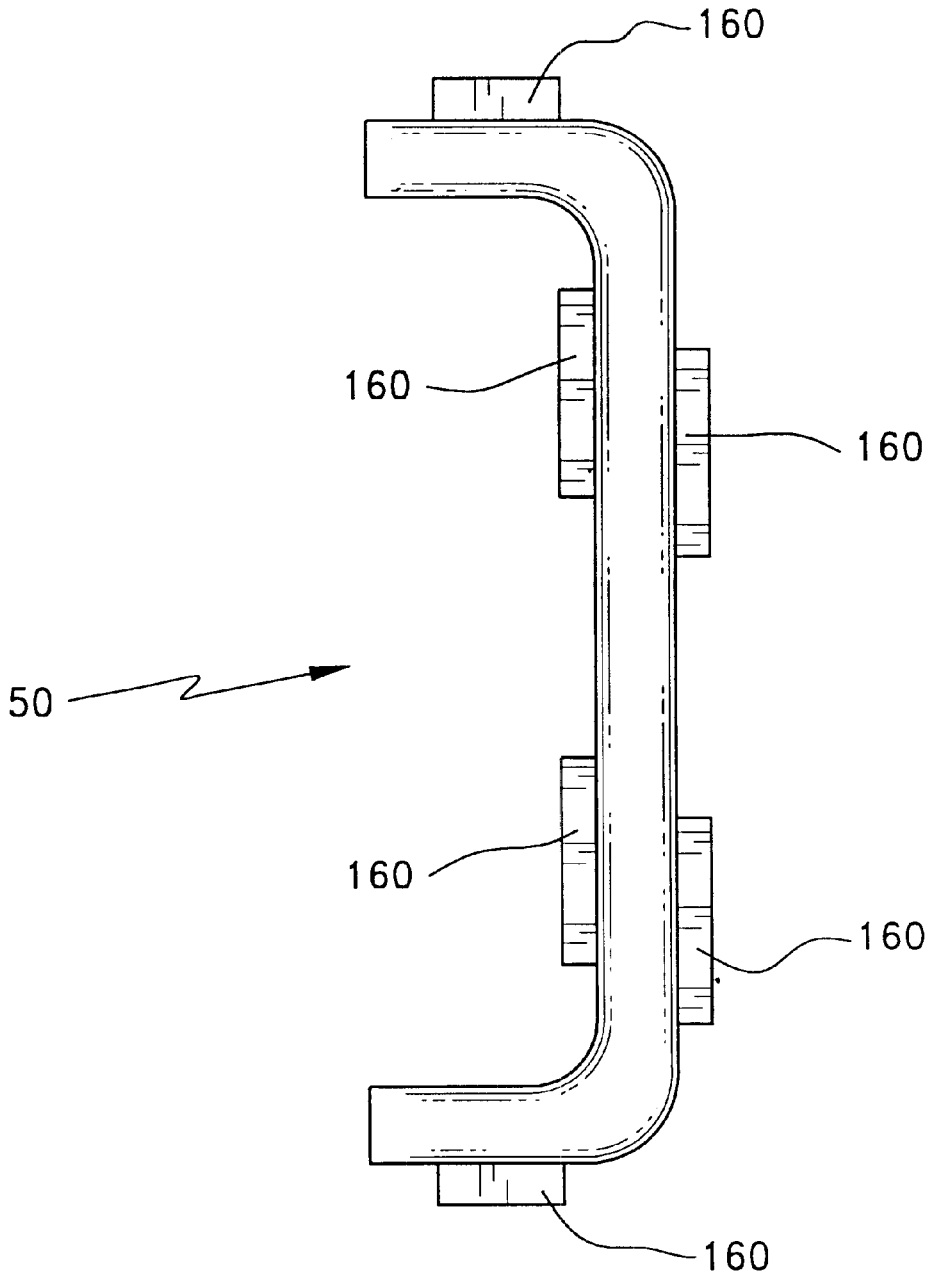
FIG. 22 is a top plan view of an alternative embodiment of a lace guide.

The gap 156 may be partially or entirely filled with a material, such as glue, that is configured to stabilize the position of the guide members 50, 52 relative to the flaps 32, 34. The material is selected to further inhibit the guide members 50, 52 from moving within the gap 156. As shown in FIG. 22, the guide members may also be equipped with anchoring members, such as tabs 160 of various shape, that are disposed at various locations thereon and that are configured to further inhibit the guide members 50, 52 from moving or deforming relative to the flap 32. The anchoring members may also comprise notches or grooves on the guide members 50, 52 that generate friction when the guide members 50, 52 begin to move and thereby inhibit further movement. The grooves may be formed using various methods, such as sanding, sandblasting, etching, etc.

Figure 23:
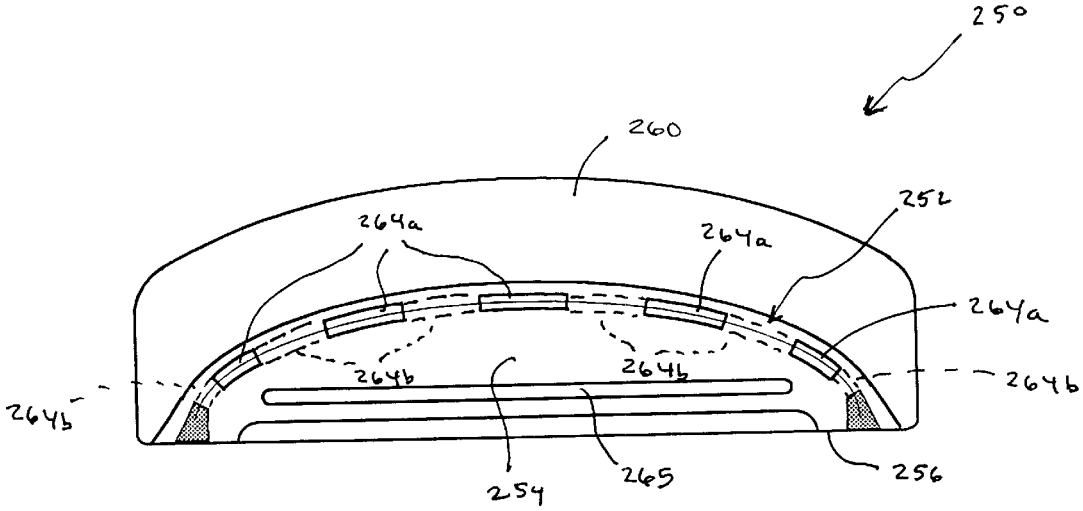
FIG. 23 is a top plan view of an alternative embodiment of a lace guide.
Figure 24:
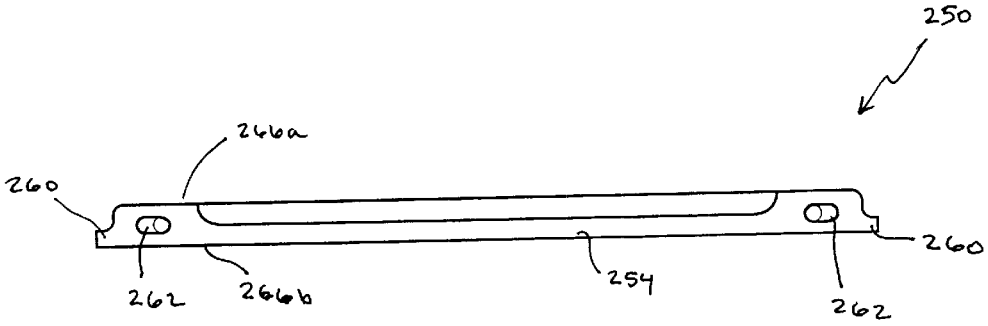
FIG. 24 is a side view of the lace guide of FIG. 23.

With reference to FIGS. 23 and 24, an alternative guide member 250 comprises a thin, single-piece structure having an internal lumen 252 for passage of the lace 23 therethrough. The guide member 250 includes a main portion 254 that defines a substantially straight inner edge 256 of the guide member. A flange portion 260 extends peripherally around one side of the main portion 254. As best shown in FIG. 22, the flange portion 260 comprises a region of reduced thickness with respect to the main portion 254. An elongate slot 265 comprised of a second region of reduced thickness is located on the upper surface 266*a* of the guide member 250.

A pair of lace exit holes 262 extend through a side surface of the lace guide member 250 and communicate with the lumen 252. The lace exit holes 262 may have an oblong shape to allow the lace 23 to exit therefrom at a variety of exit angles.

With reference to FIGS. 23 and 24, a series of upper and lower channels 264*a*, 264*b*, respectively, extend through upper and lower surfaces 266*a*, 266*b*, respectively, of the lace guide member 250. The channels 264 are arranged to extend along the pathway of the lumen 252 and communicate therewith. The location of each of the upper channels 264*a* preferably successively alternates with the location of each of the lower channels 264*b* along the lumen pathway so that the upper channels 264*a* are offset with respect to the lower channels 264*b*.

Figure 25:
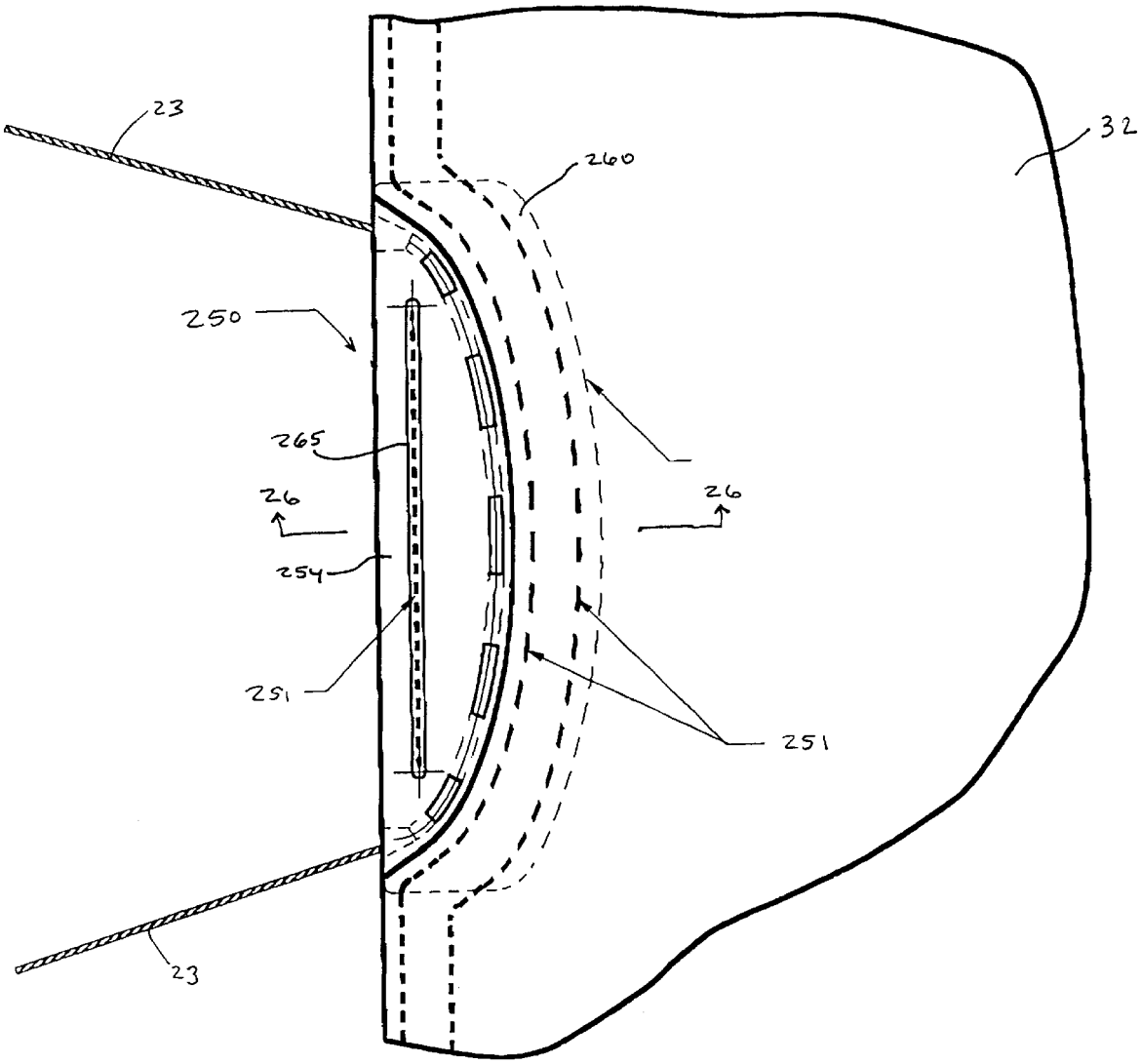
FIG. 25 is a top view of the lace guide of FIG. 23 mounted in a boot flap.
Figure 26:
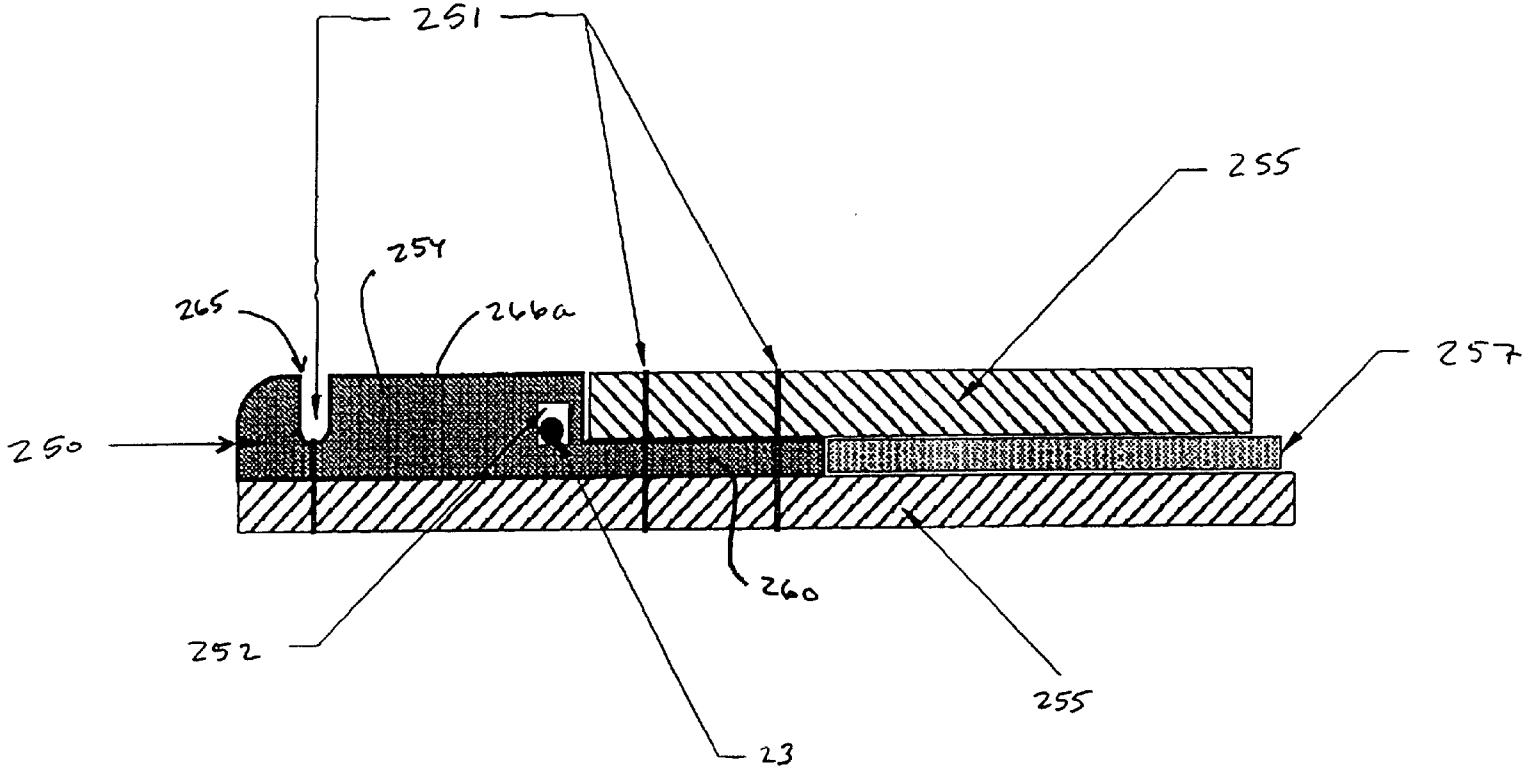
FIG. 26 is a cross-sectional view of the lace guide and boot flap along line 26—26 of FIG. 25.

With respect to FIGS. 25 and 26, the lace guide member 250 is mounted to the flaps 32, 34 by inserting the flange region 260 directly within the flaps 32, 34, such as within or between single or multiple layers 255 (FIG. 26) of material. The layers 255 may be filled with a filler material 257 to maintain a constant thickness in the flaps 32, 34.

The lace guide member 250 may be secured to the flaps 32, 34, for example, by stitching a thread through the flap 32, 34 and through the lace guide member 250 to form a stitch pattern 251. The thread is preferably stitched through the reduced thickness regions of the flange portion 260 and the elongate slot 265. Preferably, the flaps 32, 34 are cut so that the main portion 254 of the guide member 250 is exposed on the flap 32, 34 when the lace guide member 250 is mounted thereon.

With respect to FIG. 26, the upper surface 266*a* of the main portion of the guide member 250 is preferably maintained flush with the upper surface of the flaps 32, 34 to maintain a smooth and continuous appearance and to eliminate discontinuities on the flaps 32, 34. Advantageously, because the flange region 260 has a reduced thickness, the lace guide member 250 is configured to provide very little increase in the thickness of the flaps 32, 34, and preferably no increase in the thickness of the flaps. The lace guide member 250 therefore does not create any lumps in the flaps 32, 34 when the guide member 250 is mounted therein.

As mentioned, a series of upper and lower offset channels 264*a,b* extend through the lace guide member 250 and communicate with the lumen 252. The offset arrangement of the channels advantageously facilitates manufacturing of the guide members 250 as a single structure, such as by using shut-offs in an injection mold process.

The shape of the lumen may be approximately defined by an ellipse. In one embodiment, the ellipse has a major axis of about 0.970 inches and a minor axis of about 0.351 inches.

Figure 27:
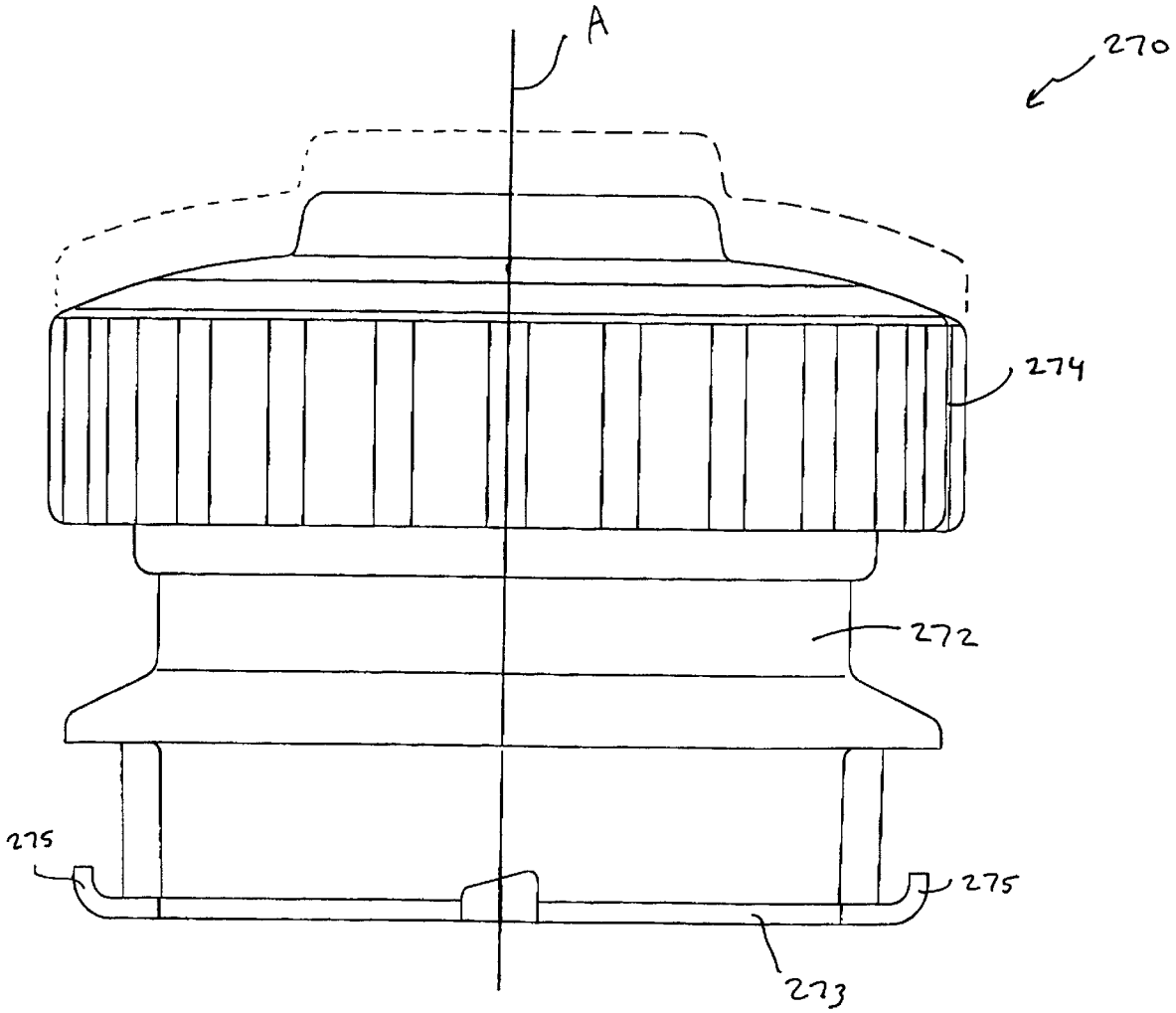
FIG. 27 is a side view of a second embodiment of the tightening mechanism.

FIG. 27 is a side view of an alternative tightening mechanism 270. The tightening mechanism 270 includes an outer housing 272 having a control mechanism, such as a rotatable knob 274, mechanically coupled thereto. The rotatable knob 274 is slideably movable along an axis A between two positions with respect to the outer housing 272. In a first, or engaged, position, the knob 274 is mechanically engaged with an internal gear mechanism located within the outer housing 272, as described more fully below. In a second, or disengaged, position (shown in phantom) the knob is disposed upwardly with respect to the first position and is mechanically disengaged from the gear mechanism. A bottom plate 273 is disposed at a bottom end of the outer housing 272. A set of arms 275 extends outwardly from the bottom plate 273.

Figure 28:
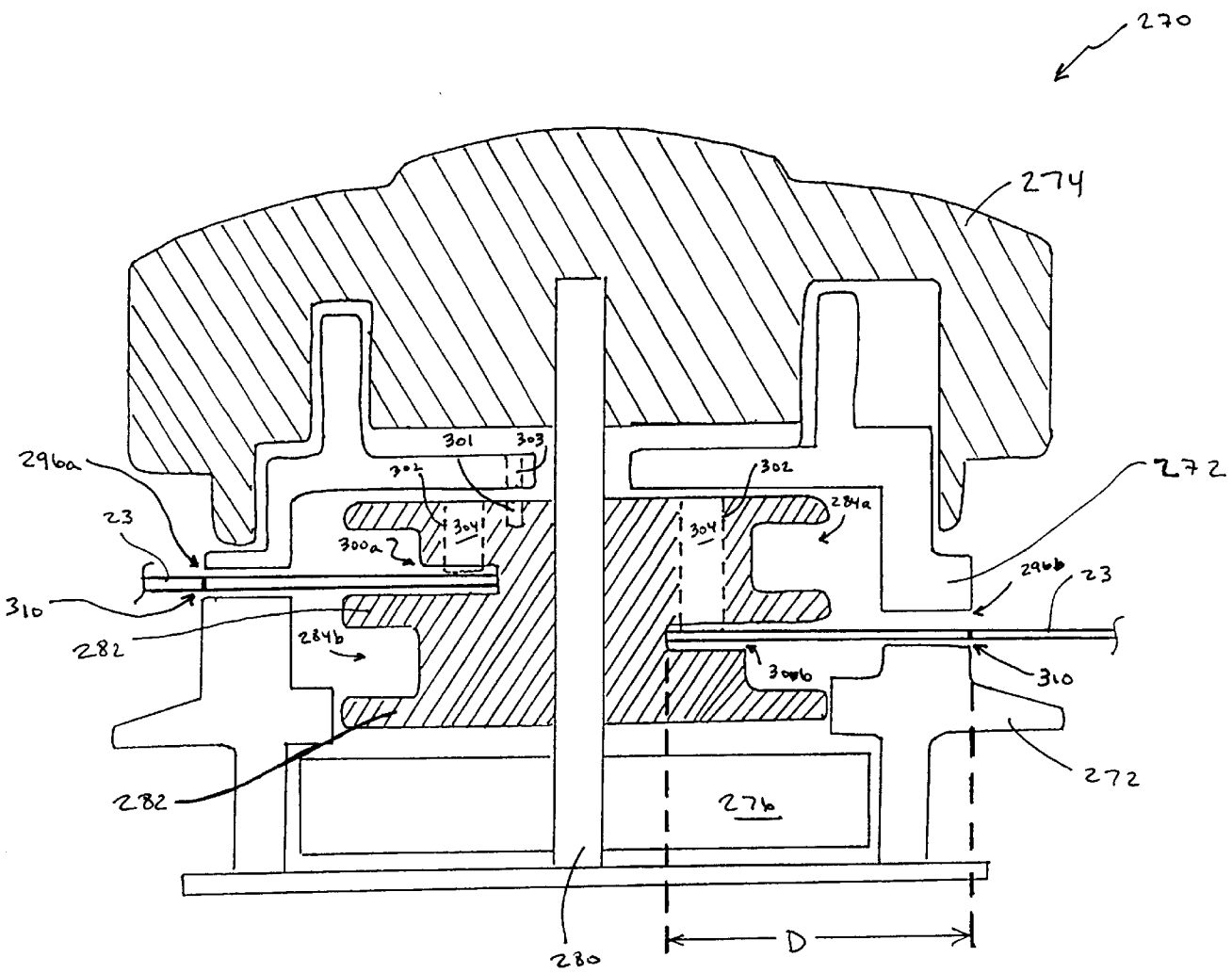
FIG. 28 is a cross-sectional view of the embodiment of FIG. 27.

FIG. 28 is a cross-sectional view of the tightening mechanism 270. A gear mechanism 276 (shown schematically) is disposed within a lower region of the outer housing 272 and is mechanically coupled to the rotatable knob 274 via a shaft 280. The shaft 280 is mechanically coupled to the knob, such as through a spline interface.

A lace wind-up spool 282 is interposed between the gear mechanism 276 and the control knob 274. The shaft 280 is journaled through the spool 282. The spool 282 is mechanically coupled to the gear mechanism 276. The spool 282 includes a pair of annular grooves 284*a,b* that are sized to receive the wound lace 23. The spool 282 rotates about the axis of the shaft 280 in response to rotation of the control knob 274.

The control knob 274 is configured to be incrementally rotated in a forward rotational direction, i.e., in a rotational direction that causes the lace 23 to wind around the spool 282. Toward this end, the control knob 274 preferably includes a series of integrally-mounted pawls 277 that engage corresponding series of ratchets on the outer housing 272. See FIGS. 31–32. The pawls 277 are preferably permanently engaged with the ratchets 279 when the control knob 274 is in the coupled or uncoupled position. The ratchet/pawl engagement prevents the knob 274 and the spool 282 from being rotated in a backwards direction (i.e., in a rotational direction opposite the rotational direction that winds the lace 23 around the spool 282) when the knob 274 is in the coupled position. This configuration prevents the user from inadvertently winding the control knob 274 backwards, which could cause the lace 23 to kink or tangle in the spool 282. The risk of tangling is especially high where a large length of lace 23 is wound around the spool, such as in the present case, where from about six inches up to about 2 feet of cable length (one half on each end) is wound around the spool 282.

Figure 30:
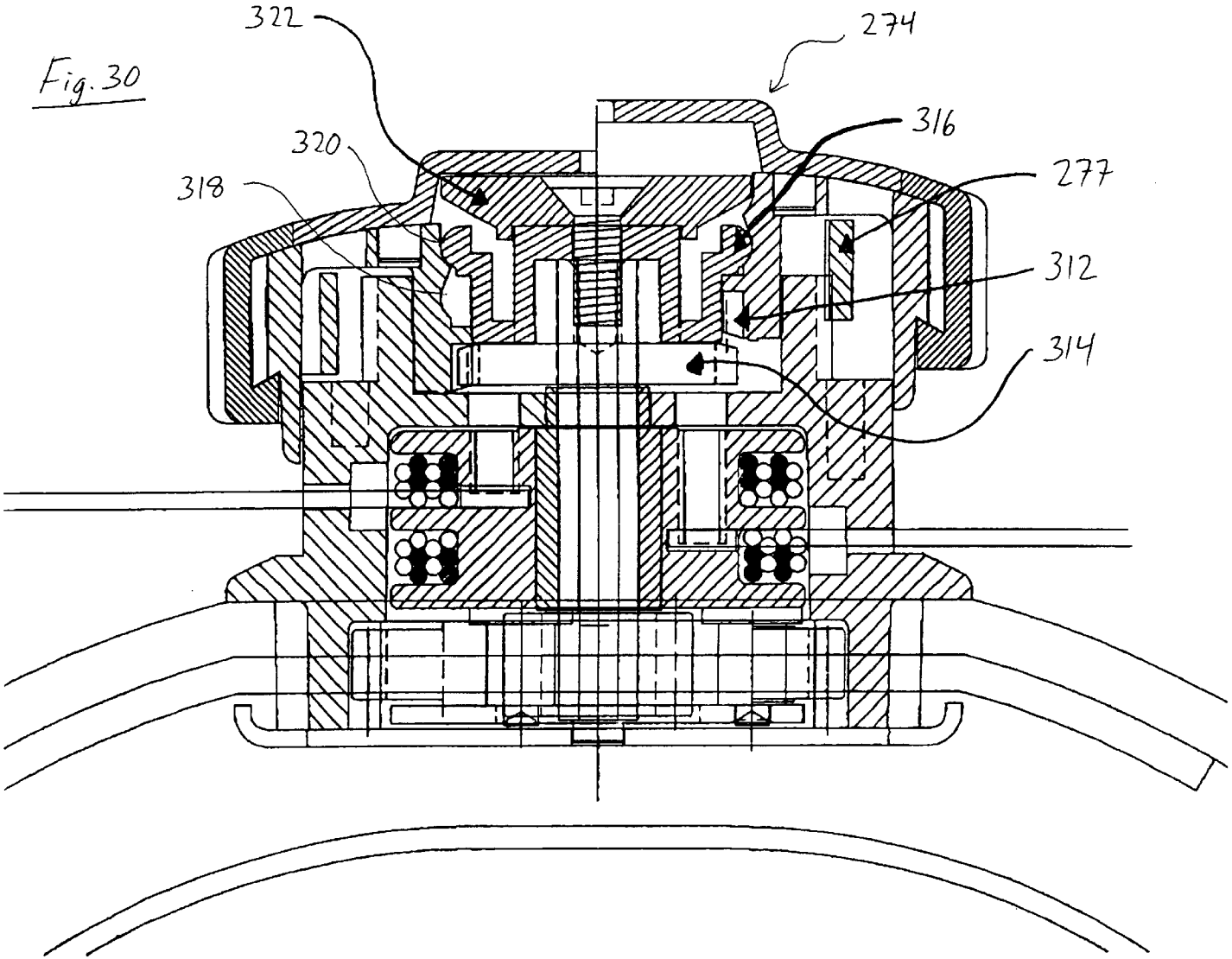
FIG. 30 is a split elevational cross section through a tightening mechanism, with the left side in the coupled position and the right side in the uncoupled position.

Referring to FIG. 30, the knob 274 is illustrated to show moveability between two positions, a coupled position (left side of drawing) and an uncoupled position (right side of drawing). The pawls 277 on the knob 274 are slideably engaged with the ratchets on the case so they are engaged in either position so the knob can never be rotated backwards. In the engaged position, the spline teeth on the knob are coupled to the spline teeth on the shaft 280 which effectively couples the ratchet/pawl system to the gear train and spool 282 so the lace 23 cannot unwind. The only way to unwind the lace 23 from the spool 282 is to pull the knob 274 out into the uncoupled position which uncouples the splines allowing the spool to spin freely in either direction. The lace is then pulled off the spool manually. A deflectable indent washer mounted onto the shaft presses against the knob 274 and falls into one of two indents in the knob. This holds the knob by friction in either the coupled or uncoupled position. Although in this embodiment, the permanently engaged ratchet/pawl assembly is uncoupled from the spool by pulling out the knob, this uncoupling could be accomplished in several different ways by someone skilled in the art.

With reference to FIG. 28, a pair of lace entry holes 296*a,b* are disposed on the side of the outer housing 272 of the tightening mechanism 270. The lace entry holes 296*a,b* communicate with the annular grooves 284*a,b,* respectively, in the spool 282. A pair of lace retention holes 300*a,b* are disposed in the spool within the grooves 284*a,b,* respectively. Each of the lace retention holes 300*a,b* comprises a cylindrical bore that extends radially into the spool 282. The lace retention holes 300*a,b* are sized to receive the end of lace 23 therein. A pair of counterbores 302 extend downwardly through the spool 282 and communicate with the lace retention holes 300*a,b*. An attachment device, such as set screw 304, is disposed within each of the counterbores 302. The set screws 304 may be rotated to incrementally project bottom ends thereof into the lace retention holes 300*a,b*.

The spool 282 may be rotated so that each of the lace retention holes 300*a,b* aligns with a corresponding lace entry hole 296*a,b*, respectively, as shown in FIG. 28. Toward this end, an alignment hole 301 is located in the spool 282 and a corresponding alignment hole 303 is located in the outer housing 272. The two alignment holes 301, 303 may be aligned through rotation of the spool 282. Preferably, when the holes 301, 303 are aligned, the lace retention holes 300 are also aligned with the lace entry holes 296. The user may thereby quickly and easily align the lace retention holes 300 with the lace entry holes 296 by aligning the alignment holes 301, 303 and then inserting a pin therein to fix the position of the spool 282 with respect to the outer housing 272.

The lace 23 is installed onto the tightening mechanism 270 by first rotating the spool 282 so that the lace retention holes 300*a,b* align with the corresponding lace entry holes 296*a,b*, as described above. The ends of the lace 23 are then each inserted into separate lace entry holes 296*a,b* until the lace ends abut an inner surface of the lace retention holes 300*a,b*. The set screws 304 are then individually rotated so that the bottom ends of the set screws 304 engaged or pinch the lace ends to thereby secures the lace 23 within the retention holes 300*a,b*. The control knob 274 may be rotated in the forward direction to wind the lace 23 around the spool 282. The lace 23 may be removed from the spool 282 by loosening the set screws 304 to disengage the set screws 304 from the lace end and then pulling the lace 23 from the spool 282.

Figure 29:
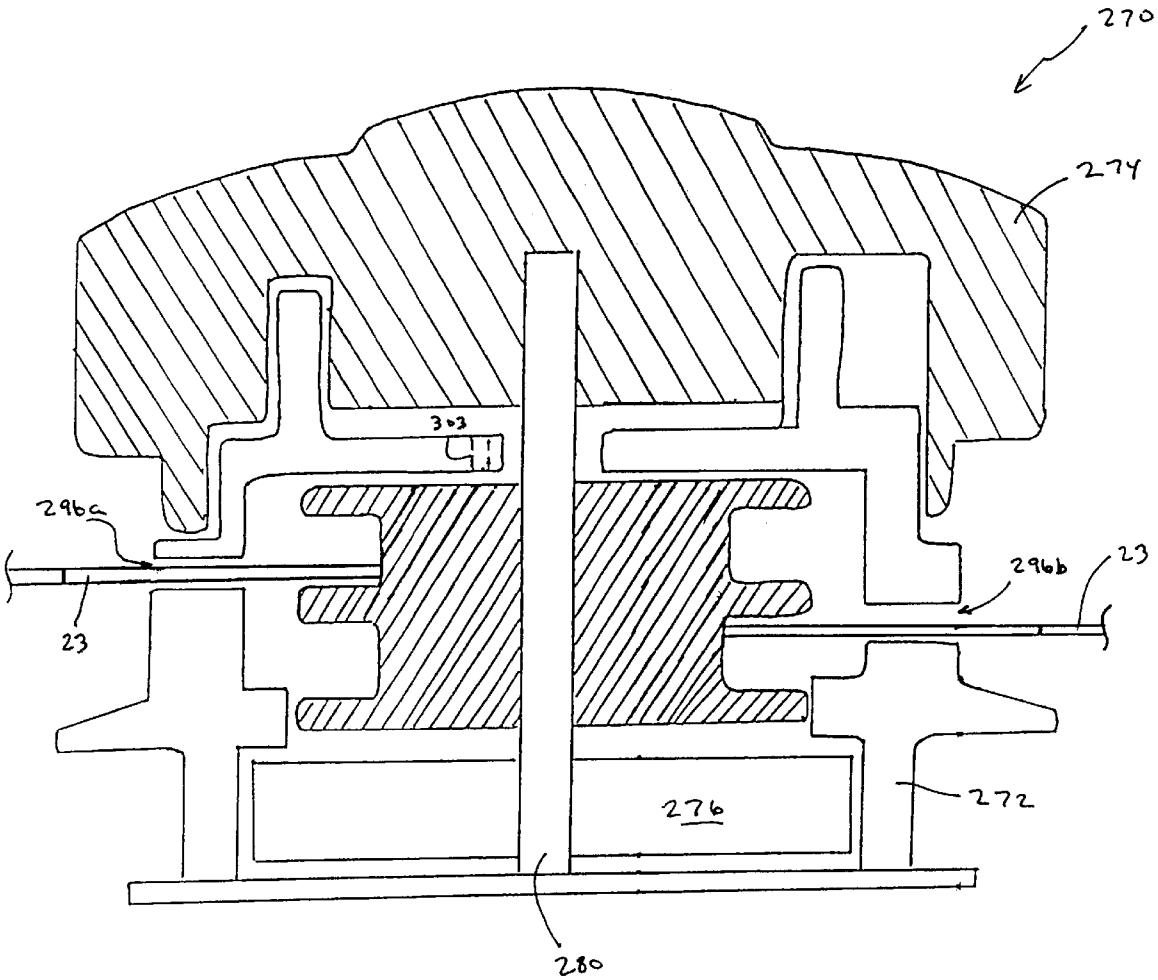
FIG. 29 is a cross-sectional view of an alternate tightening mechanism.

As mentioned, the lace entry holes 296*a,b* should be aligned with the corresponding lace retention holes 300*a,b* when inserting the lace ends into the entry holes 296*a,b*. As shown in FIG. 29, the lace end will not enter the retention hole 300 but will rather abut the inner surface of the spool 282 if the holes 296, 300 are not correctly aligned. The user will then not be able to engage the set screw with the lace 23. The ends of the lace 23 preferably each include a marker or indicator 310 to assist the user in installing the lace 23 into the lace retention hole 300*a,b*. The indicator 310 is located a preselected distance from the end of the lace 23, which is preferably substantially equal to the distance D between the inner surface of the lace retention hole 300 and the location of lace entry hole 296.

If the lace entry hole 296 and the lace retention hole 300 are misaligned during installation of the lace 23, the indicator 310 will be clearly visible to the user, as shown in FIG. 29. However, if the lace 23 is correctly positioned within the lace retention hole 300, the indicator 310 will be flush with the entry point of the lace entry hole 296. Advantageously, the user can confirm the that lace is correctly positioned within the lace retention hole 300 when the indicator on the lace is aligned with the entry point of the lace entry hole 296.

The tightening mechanism 270 is preferably removably mounted to the tongue 36 of the boot 20 between the flaps 32, 34. In one embodiment, a bayonet-type mounting system is used to mount the tightening mechanism 270 to the tongue 36. The tongue 36 may include a sheet of flexible material, such as plastic, mounted therein or thereover. The material may include die-cut hole that mates with a corresponding bayonet structure on the bottom plate 273 (FIG. 27) of the tightening mechanism 270. The die cut hole may be, for example, key-shaped so that the bayonet structure may be inserted therein and twisted to lock the bayonet structure within the hole. Advantageously, such a design allows the tightening mechanism to be quickly and easily mounted and dismounted from the boot 20 without the use of tools.

Certain functional advantages of embodiments of the present invention can be further illustrated in connection with FIGS. 30 through 32. In particular, the closure system includes a rotatable spool for receiving a lace. The spool is rotatable in a first direction to take up lace and a second direction to release lace. A knob is connected to the spool such that the spool can be rotated in the first direction to take up lace only in response to rotation of the knob. A releasable lock is provided for preventing rotation of the spool in the second direction. One convenient lock mechanism is released by pulling the knob axially away from the boot, thereby enabling the spool to rotate in the second direction to unwind lace. However, the spool rotates in the second direction only in response to traction on the lace. The spool is not rotatable in the second direction in response to rotation of the knob. This prevent tangling of the lace in or around the spool, which could occur if reverse rotation on the knob could cause the lace to loosen in the absence of a commensurate traction on the lace.

Thus, referring to FIG. 30, a knob 274 is shown split down the middle such that the left half of the figure illustrates the knob in the coupled position and the right half of the figure illustrates the knob in the uncoupled position. In the coupled position, rotation of the knob in the forward direction winds lace around the reel. Unwinding of the lace is prevented, despite the tension in the tightened system. In the uncoupled position, traction on the lace causes the reel to unwind. However, the reel is not windable in the reverse direction by rotating the knob.

One manner of accomplishing the foregoing is to provide a spline 314 on the shaft, for engagement with a spline 312 on the knob when the knob is in the coupled position. As illustrated, when the knob 274 is in the uncoupled position, the spline 314 on the shaft is disengaged from the spline 312 on the knob, thereby enabling the reel to be wound in a reverse direction in response to traction on the lace. A radially moveable indent washer 316 is slideably moveable between an uncoupled recess 318 and a coupled recess 320. Any of a wide variety of structures can be utilized to accomplish this result as will be apparent to those of skill in the art in view of the disclosure herein. The indent washer 316 both inhibits accidental movement of the knob 274 from the coupled position to the uncoupled position, and also provides tactile feedback to the user so that the knob will snap into the coupled position or the uncoupled position as desired. A stabilizing washer 322 or other spacer may also be provided, to prevent wobbling of the knob 274.

Figure 31:
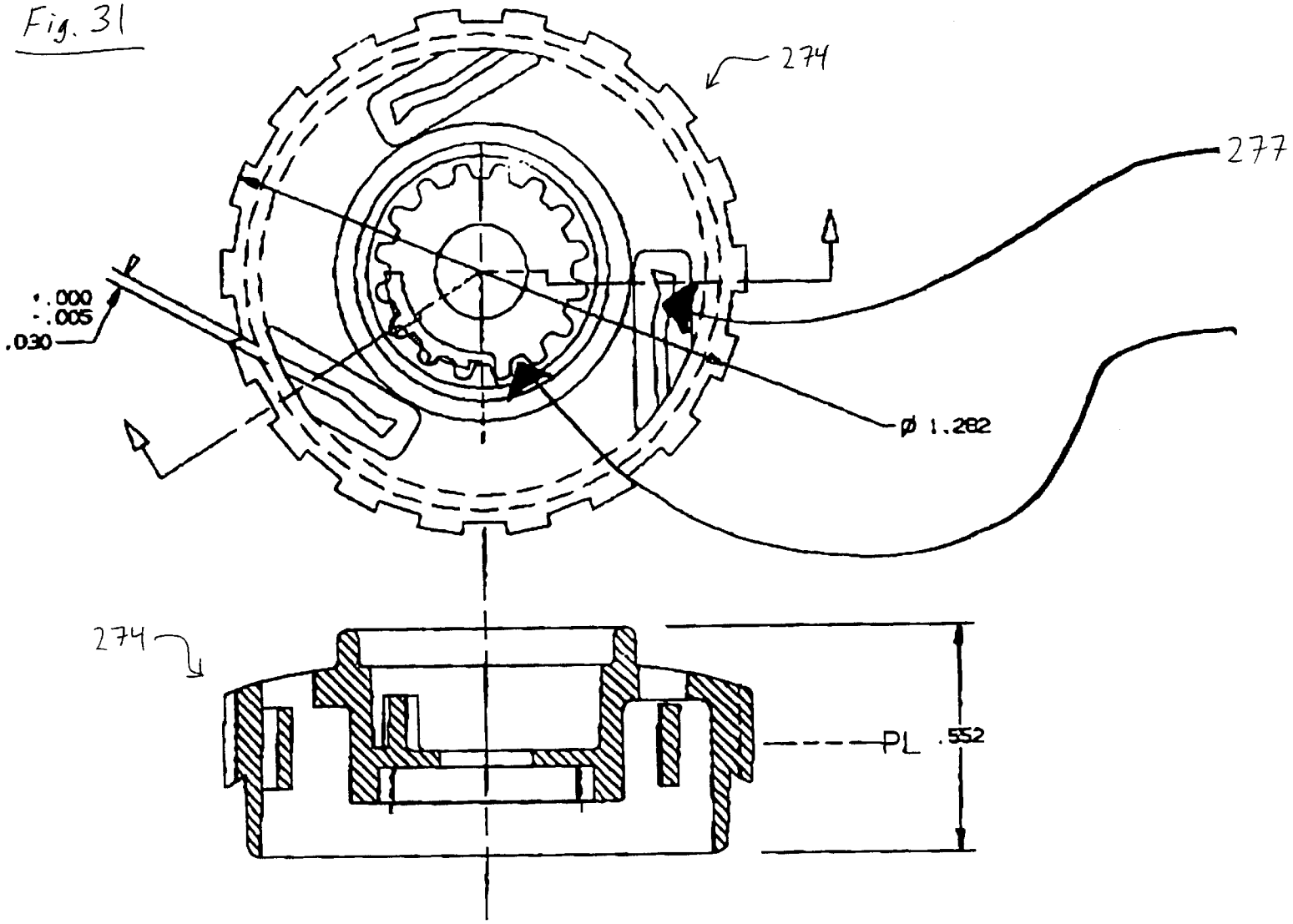
FIG. 31 is a cross section through a knob, showing integrally molded pawls.
Figure 32:
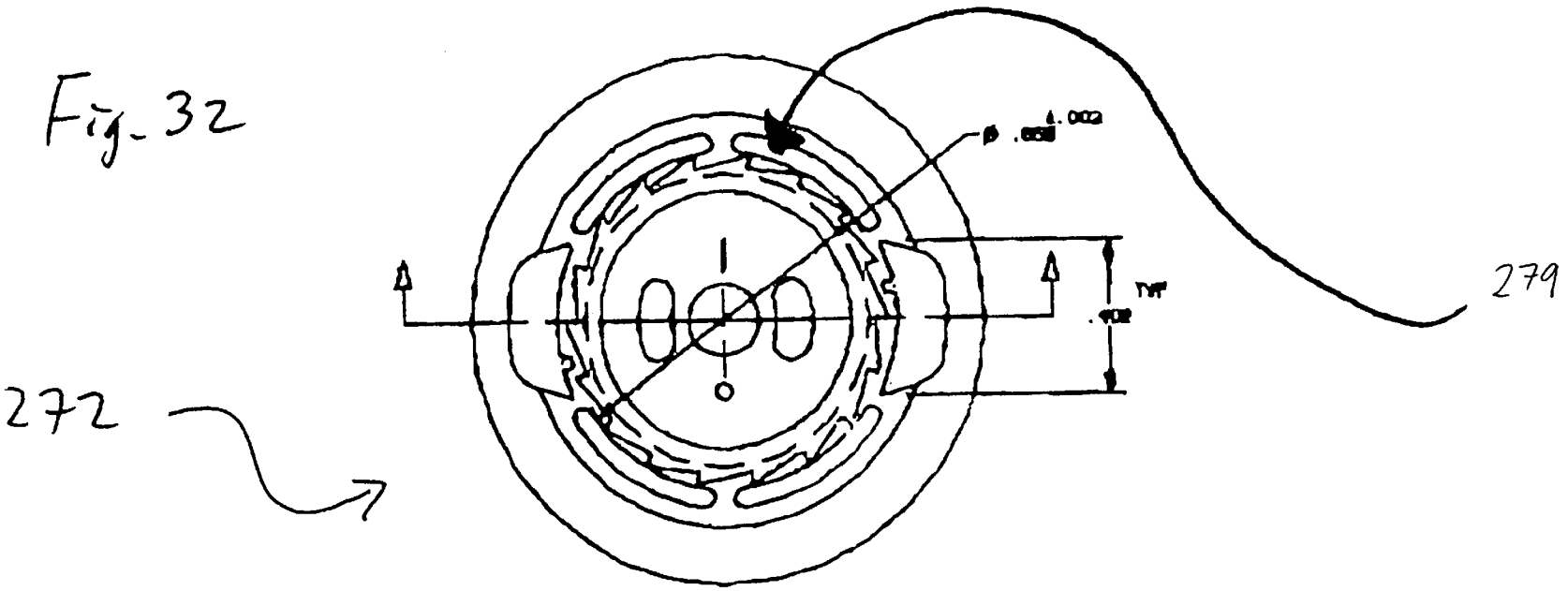
FIG. 32 is a cross section through a tightening mechanism case, illustrating ratchet teeth on the case.

Detailed views shown in FIGS. 31 and 32 illustrate, for example, a plurality of integrally molded pawls 277 on the knob 274. The pawls 277 are sufficiently axially elongated that they engage the housing in both the coupled position and the uncoupled position to prevent reverse rotation of the knob 274. The corresponding ratchet teeth 279 on the case are illustrated in FIG. 32.

Although the present invention has been described in terms of certain preferred embodiments, other embodiments can be readily devised by one with skill in the art in view of the foregoing, which will also use the basic concepts of the present invention. Accordingly, the scope of the present invention is to be defined by reference to the following claims.

What is claimed is:

1. A footwear lacing system, comprising:

a footwear member including a lacing zone in between first and second opposing sides configured to fit around a foot, the lacing zone extending from a forward portion of the footwear to at least part way up the ankle portion of the footwear;

a plurality of opposing cable guide members positioned on the opposing sides and defining a cable path which extends throughout the lacing zone;

a cable guided by the guide members and extending in a zig-zag pattern throughout the lacing zone, the cable having a first end and a second end, the first and second ends removably secured with respect to a spool; and a tightening mechanism attached to the footwear member and coupled to the spool, the tightening mechanism including a control for winding the cable around the spool to place tension on the cable thereby pulling the opposing sides towards each other.

2. A footwear lacing system as in claim 1, wherein the first and second ends are removably connected to the spool such that the cable may be removed from the footwear lacing system without removing the spool.

3. A footwear lacing system as in claim 1, wherein the cable comprises a plurality of strands.

4. A footwear lacing system as in claim 3, wherein the strands are secured together at each of the first and second ends.

5. A footwear lacing system as in claim 4, wherein the strands are welded together.

6. A footwear lacing system as in claim 1, wherein the cable is slideably positioned around the guide members to provide a dynamic fit in response to movement of the foot within the footwear.

7. A footwear lacing system as in claim 6, further comprising at least one expansion limiting band thereon, which resides in an expansion limiting plane.

8. A footwear lacing system as in claim 7, wherein the expansion limiting band is positioned on the footwear such that it surrounds the wearer's ankle.

9. A footwear lacing system as in claim 8, wherein the expansion limiting plane extends substantially horizontally through the footwear.

10. A dynamic footwear lacing system, comprising:

a footwear member including at least a foot portion and an ankle portion, and first and second opposing sides configured to fit around a foot;

a plurality of opposing guide members positioned on the opposing sides;

a cable slideably extending along the guide members, such that anterior flexing of the leg at the ankle causes a loosening of the lace in the ankle portion and a corresponding tightening of the lace in the foot portion, and subsequent posterior flexing of the leg at the ankle permits a tightening of the lace in the ankle portion and a corresponding loosening of the lace in the foot portion; and an expansion limiting element surrounding at least a portion of the footwear.

11. A dynamic footwear lacing system as in claim 10, wherein the expansion limiting strap surrounds the ankle portion of the footwear.

12. A tightening system for a boot having closure flaps, said tightening system comprising:

a plurality of guide members positioned on opposed edges of said closure flaps, said guide members each comprising an elongated lace path;

a lace slidably threaded through said lace pathways defined by the guide members and extending in a zig-zag pattern between the opposed edges;

a tightening mechanism configured to incrementally tension said lace;

a release mechanism configured to release the tension on said lace; and an expansion limiting strap defining an expansion limiting plane which extends through the boot.

13. A tightening system as in claim 12, wherein the tightening mechanism comprises a rotatable reel for receiving the lace.

14. A tightening system as in claim 13, further comprising a rotatable knob, selectively engageable with the reel.

15. A tightening system as in claim 14, wherein the knob is rotatable only in a first, lace tightening direction.

16. A tightening system as in claim 15, wherein the knob is moveable between an engaged position and a disengaged position, and the reel is rotationally locked to the knob when the knob is in the engaged position.

17. A tightening system as in claim 16, wherein the knob has an axis of rotation and the knob is moveable between the engaged position and the disengaged position by moving the knob along the axis of rotation.

18. A closure system for drawing first and second sides of an article of footwear towards each other to tighten the footwear around a foot, comprising:

a rotatable spool for receiving a lace, the spool rotatable in a first direction to take up lace and a second direction to release lace;

a knob coaxially aligned with and connected to the spool such that the spool can be rotated in the first direction in response to rotation of the knob; and a releasable lock for preventing rotation of the spool in the second direction;

wherein releasing the lock permits the spool to rotate in the second direction in response to tension on the lace, but the spool is not rotatable in the second direction in response to rotation of the knob.

* * * * *